US009478371B2

(12) United States Patent
Sharrah et al.

(10) Patent No.: US 9,478,371 B2
(45) Date of Patent: Oct. 25, 2016

(54) ELECTRICAL SWITCH, AS FOR CONTROLLING A FLASHLIGHT

(75) Inventors: Raymond L Sharrah, Collegeville, PA (US); Peter J Ziegenfuss, Sellersville, PA (US); Mark W Snyder, Hockessin, DE (US)

(73) Assignee: STREAMLIGHT, INC., Eagleville, PA (US)

( * ) Notice: Subject to any disclaimer, the term of this patent is extended or adjusted under 35 U.S.C. 154(b) by 0 days.

(21) Appl. No.: 13/601,356

(22) Filed: Aug. 31, 2012

(65) Prior Publication Data

US 2012/0326625 A1 Dec. 27, 2012

Related U.S. Application Data

(63) Continuation of application No. 12/975,575, filed on Dec. 22, 2010, now Pat. No. 8,258,416, which is a continuation of application No. 12/693,075, filed on Jan. 25, 2010, now Pat. No. 7,880,100, which is a continuation of application No. 11/958,804, filed on Dec. 18, 2007, now Pat. No. 7,652,216.

(51) Int. Cl.
*H01H 9/00* (2006.01)
*H01H 13/48* (2006.01)
(Continued)

(52) U.S. Cl.
CPC ..... *H01H 13/48* (2013.01); *H01H 13/64* (2013.01); *F21V 23/0414* (2013.01); *H01H 1/18* (2013.01); *H01H 2227/028* (2013.01); *H01H 2227/032* (2013.01)

(58) Field of Classification Search
CPC ..... F21L 4/085; F21L 4/0027; F21L 4/005; H05B 37/00; H05B 33/0854; F21V 23/0492; F21V 23/0421; F21V 14/025; H01H 13/48; H01H 13/64; H01H 2227/032; H01H 2227/028
USPC ..... 200/1 B
See application file for complete search history.

(56) References Cited

U.S. PATENT DOCUMENTS 1,538,992 A 5/1925 Hopkins
2,530,913 A 11/1950 Shackel
(Continued)

FOREIGN PATENT DOCUMENTS

DE 20006963 U1 8/2000
DE 10161017 A1 6/2003
(Continued)

OTHER PUBLICATIONS

SureFire U2 Ultra LED Flashlight (including larger image), © 2001-2005, 3 pages, http://www.surefire.com/maxexp/main/co_disp/displ/prrfnbr/24187/sesent/00.
(Continued)

*Primary Examiner* — Renee Luebke
*Assistant Examiner* — Lheiren Mae A Caroc
(74) *Attorney, Agent, or Firm* — Dann, Dorfman, Herrell and Skillman; Stephen Eland

(57) ABSTRACT

An electrical switch and a flashlight employing the switch may comprise a base having three electrical conductors thereon and an electrically conductive flexible dome adjacent the base. The flexible dome has plural longer legs extending from its dome and in electrical contact with a first conductor, has a shorter leg extending from its dome and overlying a second conductor, and has its dome overlying a third conductor. A spring may extend from the base of the switch. A pushbutton may be moved to apply sufficient force to cause the shorter leg to contact the second conductor and the dome to contact the third conductor. A spring may be between the pushbutton and the flexible dome to couple force to the flexible dome.

12 Claims, 4 Drawing Sheets

(51) Int. Cl.

| | |
|---|---|
| ***H01H 13/64*** | (2006.01) |
| *F21V 23/04* | (2006.01) |
| *H01H 1/18* | (2006.01) |

(56) References Cited

U.S. PATENT DOCUMENTS

| | | | | |
|---|---|---|---|---|
| 3,796,843 | A * | 3/1974 | Durkee | H01H 13/7006 200/279 |
| 3,941,964 | A | 3/1976 | Yoder | |
| 4,001,803 | A | 1/1977 | Lombardo | |
| 4,074,122 | A | 2/1978 | Moore | |
| 4,149,224 | A | 4/1979 | King et al. | |
| 4,156,802 | A | 5/1979 | Gilano et al. | |
| 4,228,485 | A | 10/1980 | Hubbard et al. | |
| 4,274,130 | A | 6/1981 | Elliott | |
| 4,329,039 | A | 5/1982 | Kaneko | |
| 4,346,329 | A | 8/1982 | Schmidt | |
| 4,439,646 | A * | 3/1984 | Bouvrande | 200/5 A |
| 4,649,323 | A | 3/1987 | Pearlman et al. | |
| 4,764,708 | A | 8/1988 | Roudeski | |
| 4,782,432 | A | 11/1988 | Coffman | |
| 4,823,242 | A | 4/1989 | Maglica et al. | |
| 4,831,504 | A | 5/1989 | Nishizawa et al. | |
| 4,841,417 | A | 6/1989 | Maglica et al. | |
| 4,864,474 | A | 9/1989 | Maglica | |
| 4,905,129 | A | 2/1990 | Sharrah | |
| 4,962,347 | A | 10/1990 | Burroughs et al. | |
| 5,066,841 | A | 11/1991 | Zoller et al. | |
| 5,121,308 | A | 6/1992 | Maglica et al. | |
| 5,124,892 | A | 6/1992 | Lambert | |
| 5,138,538 | A | 8/1992 | Sperling | |
| 5,248,919 | A | 9/1993 | Hanna et al. | |
| 5,268,826 | A | 12/1993 | Greene | |
| 5,313,027 | A | 5/1994 | Inoue et al. | |
| 5,359,779 | A | 11/1994 | Polk | |
| 5,386,351 | A | 1/1995 | Tabor | |
| 5,412,548 | A | 5/1995 | Yee | |
| 5,418,433 | A | 5/1995 | Nilssen | |
| 5,432,689 | A | 7/1995 | Sharrah et al. | |
| 5,486,432 | A | 1/1996 | Sharrah et al. | |
| 5,541,822 | A | 7/1996 | Bamber | |
| 5,629,105 | A | 5/1997 | Matthews | |
| 5,682,558 | A | 10/1997 | Kirigaya et al. | |
| 5,749,646 | A | 5/1998 | Brittell | |
| 5,790,013 | A | 8/1998 | Hauck | |
| 5,806,961 | A | 9/1998 | Dalton et al. | |
| 5,822,905 | A | 10/1998 | Teetzel | |
| 5,839,821 | A | 11/1998 | LeZotte | |
| 5,871,272 | A | 2/1999 | Sharrah et al. | |
| 5,898,147 | A | 4/1999 | Domzalski et al. | |
| 5,907,138 | A | 5/1999 | Metzler | |
| 6,000,811 | A | 12/1999 | Bordak | |
| 6,004,004 | A | 12/1999 | Altman et al. | |
| 6,017,129 | A | 1/2000 | Krietzman | |
| 6,024,471 | A | 2/2000 | McDermott | |
| 6,040,660 | A | 3/2000 | Schmidt et al. | |
| 6,045,237 | A | 4/2000 | Parsons et al. | |
| 6,046,572 | A | 4/2000 | Matthews et al. | |
| 6,095,661 | A | 8/2000 | Lebens et al. | |
| 6,184,794 | B1 | 2/2001 | Tucholski | |
| 6,184,930 | B1 | 2/2001 | Mitsuhashi et al. | |
| 6,186,641 | B1 | 2/2001 | Parker | |
| 6,190,018 | B1 | 2/2001 | Parsons et al. | |
| RE37,092 | E | 3/2001 | Sharrah et al. | |
| 6,222,138 | B1 | 4/2001 | Matthews et al. | |
| 6,224,235 | B1 | 5/2001 | Parker | |
| 6,239,555 | B1 | 5/2001 | Rachwal | |
| 6,249,089 | B1 | 6/2001 | Bruwer | |
| 6,259,862 | B1 | 7/2001 | Marino et al. | |
| 6,283,609 | B1 | 9/2001 | Parsons et al. | |
| 6,296,367 | B1 | 10/2001 | Parsons et al. | |
| 6,296,371 | B1 | 10/2001 | Shiau | |
| 6,305,818 | B1 | 10/2001 | Lebens et al. | |
| 6,307,328 | B1 | 10/2001 | Ko et al. | |
| 6,316,880 | B1 | 11/2001 | Broadhurst | |
| 6,357,893 | B1 | 3/2002 | Belliveau | |
| 6,386,730 | B1 | 5/2002 | Matthews | |
| 6,388,390 | B2 | 5/2002 | Rachwal | |
| 6,435,689 | B2 | 8/2002 | Pitts | |
| 6,474,833 | B1 | 11/2002 | Parsons et al. | |
| 6,488,388 | B2 | 12/2002 | Jones | |
| 6,488,390 | B1 | 12/2002 | Lebens et al. | |
| 6,504,708 | B2 | 1/2003 | Yehudai | |
| 6,533,436 | B2 | 3/2003 | Krietzman et al. | |
| 6,534,926 | B1 | 3/2003 | Miller et al. | |
| 6,545,239 | B2 | 4/2003 | Spedale et al. | |
| 6,593,909 | B1 | 7/2003 | Chou | |
| 6,611,697 | B1 | 8/2003 | Ewing et al. | |
| 6,616,296 | B1 | 9/2003 | Roux et al. | |
| 6,621,225 | B2 | 9/2003 | Bruwer | |
| 6,623,140 | B2 | 9/2003 | Watterson et al. | |
| 6,635,832 | B1 | 10/2003 | Oster et al. | |
| 6,641,279 | B1 | 11/2003 | Williams | |
| 6,650,066 | B2 | 11/2003 | Bruwer | |
| 6,659,621 | B2 | 12/2003 | Sharrah et al. | |
| 6,702,452 | B2 | 3/2004 | Jigamian et al. | |
| 6,747,218 | B2 | 6/2004 | Huseman et al. | |
| 6,755,549 | B2 | 6/2004 | Rogers et al. | |
| 6,786,616 | B1 | 9/2004 | Parsons | |
| 6,794,589 | B2 | 9/2004 | Kubat et al. | |
| 6,805,461 | B2 | 10/2004 | Witte | |
| 6,808,287 | B2 | 10/2004 | Lebens et al. | |
| 6,808,289 | B2 | 10/2004 | Reed | |
| 6,814,464 | B2 | 11/2004 | Galli | |
| 6,814,465 | B2 | 11/2004 | Forsythe | |
| 6,814,466 | B2 | 11/2004 | Parsons et al. | |
| 6,841,941 | B2 | 1/2005 | Kim et al. | |
| 6,866,400 | B2 | 3/2005 | Wood et al. | |
| 6,880,951 | B2 | 4/2005 | Yoon | |
| 6,893,140 | B2 | 5/2005 | Storey et al. | |
| 6,893,143 | B2 | 5/2005 | Opolka | |
| 6,896,392 | B2 | 5/2005 | Jigamian et al. | |
| 6,909,250 | B2 | 6/2005 | Jigamian et al. | |
| 6,942,365 | B2 | 9/2005 | Galli | |
| 6,952,084 | B2 | 10/2005 | Bruwer | |
| 6,966,677 | B2 | 11/2005 | Galli | |
| 6,971,762 | B2 | 12/2005 | Galli | |
| 6,976,766 | B2 | 12/2005 | Galli | |
| 6,979,104 | B2 | 12/2005 | Brass et al. | |
| 6,984,900 | B1 | 1/2006 | Bruwer | |
| 7,033,042 | B2 | 4/2006 | Lim | |
| 7,059,742 | B2 | 6/2006 | Chen | |
| 7,063,435 | B2 | 6/2006 | Dallas et al. | |
| 7,084,526 | B2 | 8/2006 | Bruwer | |
| 7,084,531 | B2 | 8/2006 | Bruwer | |
| 7,090,374 | B2 | 8/2006 | Arthur | |
| 7,119,459 | B2 | 10/2006 | Bruwer et al. | |
| 7,161,311 | B2 | 1/2007 | Mueller et al. | |
| 7,166,813 | B2 | 1/2007 | Soma et al. | |
| 7,186,002 | B2 | 3/2007 | Matthews et al. | |
| 7,293,893 | B2 | 11/2007 | Kim | |
| RE40,027 | E | 1/2008 | Matthews | |
| 7,334,915 | B2 | 2/2008 | Kim | |
| 7,393,120 | B2 | 7/2008 | Kang et al. | |
| 7,434,956 | B2 | 10/2008 | Mattheis | |
| 7,441,920 | B2 | 10/2008 | Kang et al. | |
| 7,492,063 | B2 | 2/2009 | Bayat | |
| 7,540,625 | B2 * | 6/2009 | Matthews et al. | 362/205 |
| 7,652,216 | B2 * | 1/2010 | Sharrah et al. | 200/1 B |
| 7,674,003 | B2 | 3/2010 | Sharrah et al. | |
| 7,737,373 | B2 * | 6/2010 | In et al. | 200/1 B |
| 7,738,229 | B2 | 6/2010 | Bayat | |
| 7,880,100 | B2 * | 2/2011 | Sharrah et al. | 200/1 B |
| 7,883,243 | B2 | 2/2011 | Snyder | |
| 8,258,416 | B2 * | 9/2012 | Sharrah et al. | 200/1 B |
| 2002/0021573 | A1 | 2/2002 | Zhang | |
| 2002/0097576 | A1 | 7/2002 | Sharrah et al. | |
| 2003/0095408 | A1 | 5/2003 | Opolka | |
| 2003/0107885 | A1 | 6/2003 | Galli | |
| 2003/0123253 | A1 | 7/2003 | Krietzman et al. | |
| 2003/0223227 | A1 | 12/2003 | Levine | |
| 2004/0050188 | A1 | 3/2004 | Richards et al. | |
| 2004/0190288 | A1 | 9/2004 | Hsu | |
| 2004/0217655 | A1 | 11/2004 | Bruwer | |

(56) References Cited

U.S. PATENT DOCUMENTS

| | | | |
|---|---|---|---|
| 2004/0227409 | A1 | 11/2004 | Bruwer |
| 2005/0002186 | A1 | 1/2005 | Krieger et al. |
| 2005/0007777 | A1 | 1/2005 | Klipstein et al. |
| 2005/0024864 | A1 | 2/2005 | Galli |
| 2005/0063179 | A1 | 3/2005 | Niemann |
| 2005/0077837 | A1 | 4/2005 | Kim et al. |
| 2005/0083626 | A1 | 4/2005 | Bruwer |
| 2005/0121980 | A1 | 6/2005 | Bruwer |
| 2005/0122710 | A1 | 6/2005 | Kim |
| 2005/0122712 | A1 | 6/2005 | Kim |
| 2005/0122714 | A1 | 6/2005 | Matthews et al. |
| 2005/0128741 | A1 | 6/2005 | Matthews et al. |
| 2005/0140310 | A1 | 6/2005 | Bruwer |
| 2005/0237734 | A1 | 10/2005 | Krieger |
| 2005/0237737 | A1 | 10/2005 | Kim |
| 2006/0109655 | A1 | 5/2006 | Martin |
| 2006/0158884 | A1 | 7/2006 | Kim |
| 2006/0164828 | A1 | 7/2006 | Kim |
| 2007/0109774 | A1 | 5/2007 | Booty |
| 2007/0145912 | A1 | 6/2007 | Spartano et al. |
| 2007/0183152 | A1 | 8/2007 | Hauck et al. |
| 2007/0246335 | A1 | 10/2007 | Sharrah et al. |
| 2007/0247839 | A1 | 10/2007 | Matthews et al. |
| 2008/0055891 | A1 | 3/2008 | Mattheis |
| 2008/0180032 | A1 | 7/2008 | Kim et al. |
| 2009/0283390 | A1 | 11/2009 | Sharrah et al. |
| 2010/0033963 | A1 | 2/2010 | Maglica |
| 2010/0176750 | A1 | 7/2010 | West |
| 2010/0177507 | A1 | 7/2010 | West |

FOREIGN PATENT DOCUMENTS

| | | | |
|---|---|---|---|
| DE | 20313781 | U1 | 2/2004 |
| EP | 0207691 | | 1/1987 |
| EP | 1848016 | | 10/2007 |
| GB | 1537686 | | 1/1979 |
| JP | 06267307 | | 9/1994 |
| JP | 8007602 | | 1/1996 |
| JP | 2002245895 | | 8/2002 |
| JP | 2003331681 | | 11/2003 |
| JP | 2005332664 | | 12/2005 |
| KR | 1020060063721 | | 6/2006 |
| KR | 20-0423038 | | 8/2006 |
| WO | WO 01/60127 | A3 | 8/2001 |
| WO | WO 01/77575 | A1 | 10/2001 |
| WO | WO 01/97379 | A2 | 12/2001 |
| WO | WO 2005047763 | | 5/2005 |
| WO | WO 2005060715 | | 7/2005 |
| WO | WO 2005124805 | | 12/2005 |
| WO | WO 2006023402 | | 3/2006 |

OTHER PUBLICATIONS

LED Lights Comparison Chart, Printed Dec. 5, 2005, 1 page, http:/www.surefire.com/surefire/content/comparechart_LED.html.

Flashlight Reviews and LED Modifications, FlashlightReviews.com, "In2theLight Trio, 29 LED Flashlight", 7 pages (prior to filing date).

European Patent Office, "Partial European Search Report for European Application No. 07251641", Jun. 18, 2007, 3 pages.

JPO and INPIT, www4.ipdl.inpit.go.jp, Machine Translation of JP2003-331681, including: description of drawings (1 page), drawings (4 pages), detailed description (10 pages) and claims (2 pages), printed Jul. 26, 2007.

European Patent Office, "European Search Report, including European Search Opinion for EP Application No. 07251641.2", Oct. 15, 2007, 9 pages.

Snaptron Inc., "Metal domes, snap domes and tactile dome switches for membrane and momentary switches", www.snaptron.com, for "DT Series low profile double action dome contact", _2003-2006, 6 pages.

Streamlight, "Stinger, PolyStinger, SuperStinger, StingerXT Operating Instructions", _1998, 3pgs.

City of Los Angeles, California, "Quotation/Auction Event Details", Nov. 3, 2005, pp. 10-17, Flashlight/Accessories, LAPD, Custom-made, ID# City-EV00000100.

City of Los Angeles, California, "Quotation/Auction Event Details", Flashlight, Custom-made per LAPD Specs, ID# City-EV00000321, Mar. 6, 2006, 12 pgs.

City of Los Angeles, California, "Quotation/Auction Event Details", Flashlight, Custom-made per LAPD Specs, ID# City-EV00000189, Jan. 18, 2006, 12 pgs.

Paul Rosenberg, "House Wiring 8$^{th}$ Edition Updated for the 2005 NEC", pp. 162-165 and 174-175, _2004, 7 pages.

Terrell Croft, "American Electricians' Handbook 14$^{th}$ Edition", _2002, 6 pages.

Roger W. Herrell, "Letter to Christopher Darrow, Esq. Re: Pelican Products Allegations regarding U.S. Pat. No. 7,393,120", Oct. 31, 2008, 16 pages.

Military Office Resupply Express, "3 way Flashlight w/ Magnet", printed Dec. 3, 2007, 1 page, http://www.usa-stationery.com/catalog/product_info.php?cPath=1500267_150.

Los Angeles Police Department Issued Flashlight Specifications, Mar. 2, 2006, 3 pgs.

http://www.pelican.com/lights_detail.php?recordID=1830, 2006, 1 page.

http://www.pelican.com/lights_detail.php?recordID=1930, 2001, 2 pages.

http://www.pelican.com/lights_detail.php?recordID=2320, 2003, 2 pages.

http://www.pelican.com/lights_detail.php?recordID=2330, 2004, 2 pages.

http://www.pelican.com/lights_detail.php?recordID=2340, 2000, 2 pages.

http://www.pelican.com/lights_detail.php?recordID=2430, 2005, 1 page.

http://www.pelican.com/lights_detail.php?recordID=7050, 1990, 2 pages.

http://www.pelican.com/lights_detail.php?recordID=7060, 2007, 2 pages.

http://www.pelican.com/lights_detail.php?recordID=8040, 2000, 2 pages.

http://www.pelican.com/lights_detail.php?recordID=8050, 1999, 2 pages.

International Search Report, PCT/US2007/073464, dated Mar. 6, 2008, 6 pages.

International Search Report, PCT/US2007/072782, dated Mar. 20, 2008, 6 pages.

Office Action, Canadian Application No. 2,614,709, dated Mar. 6, 2008, 4 pages.

Patent Cooperation Treaty, International Application No. PCT/US2008/086433, "Notification of Transmittal of the International Search Report and the Written Opinion of the International Searching Authority, or the Declaration", Jul. 27, 2009, 11 pages.

Smith & Wesson, "6 LED Galaxy Flashlight" http://www.polotmall.com/product/Smith-Wesson-6-LED-Galaxy-Flashlight/flashlights, printed Aug. 31, 2009, 5 pages.

Inova, "T Series", http://www.inovalight.com/t.html, printed Aug. 31, 2009, 17 pages.

International Preliminary Report on Patentability, dated 22 Jun. 2010, of International Application No. PCT/US2008/086433.

Extended European Search Report issued in EP Appl. No. 08862997 on Oct. 25, 2013.

* cited by examiner

FIGURE 1B
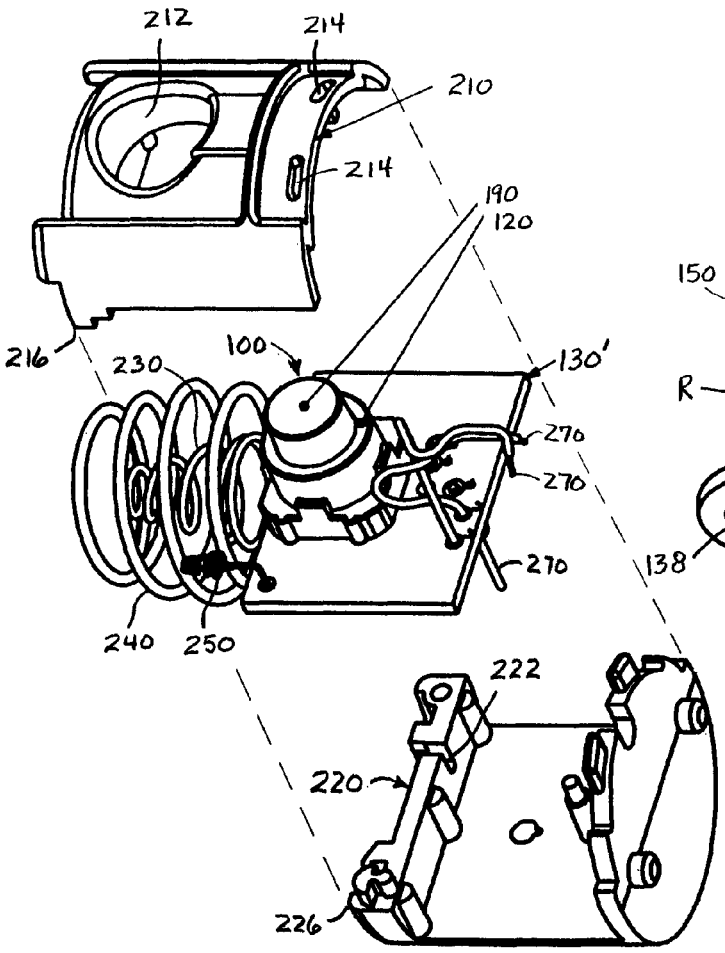
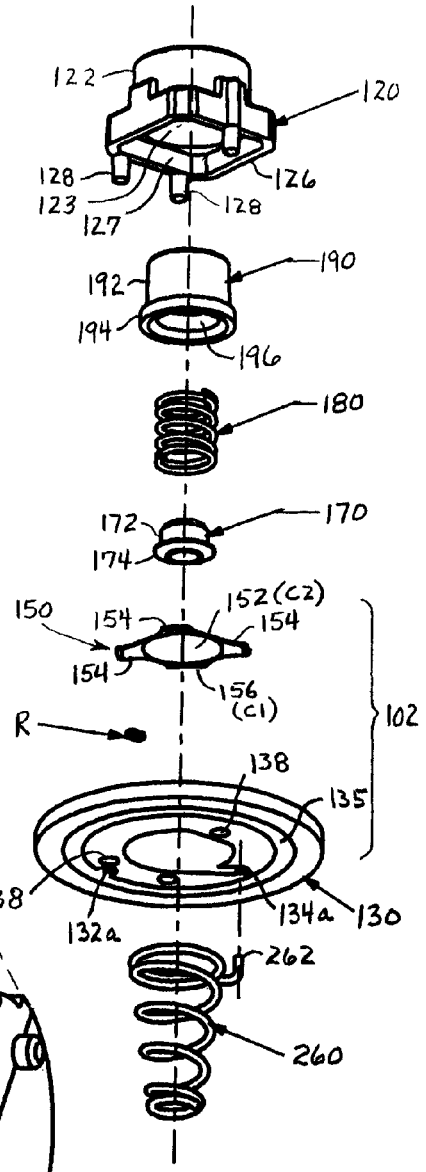
FIGURE 2

ELECTRICAL SWITCH, AS FOR CONTROLLING A FLASHLIGHT

This Application is a continuation of U.S. patent application Ser. No. 12/975,575 filed on Dec. 22, 2010, set to issue as U.S. Pat. No. 8,258,416, which is a continuation of U.S. patent application Ser. No. 12/693,075 filed on Jan. 25, 2010, now issued as U.S. Pat. No. 7,880,100, which is a continuation of U.S. patent application Ser. No. 11/958,804 filed on Dec. 18, 2007, now issued as U.S. Pat. No. 7,652,216. The entire disclosure of each of the foregoing applications is hereby incorporated herein by reference in its entirety.

The present invention relates to an electrical switch and, in particular, to an electrical switch having a domed switching element. Such electrical switch is suitable for controlling a flashlight as well as other devices and apparatus.

Many conventional flashlights are turned on and off using a pushbutton that actuates a mechanical switch mechanism that opens and closes one or more sets of electrical contacts. One conventional mechanical switch is a so-called "clicker switch" that has a ratcheting mechanism that operates similarly to that of a clicker-type ball-point pen—press once and it "clicks" ON, press again and it "clicks" OFF, thereafter alternating between a closed contact ("ON") and an open contact ("OFF") so that the light alternates between ON and OFF with each successive "click," i.e. actuation.

The conventional clicker switch mechanism can be constructed so that the electrical switch contacts close to make a connection before the clicker mechanism ratchets to sustain the contact closure, and to break the contact closure if the pushbutton is released without actuating the ratchet mechanism, thereby providing a momentary switch closure, in addition to the sequential ratcheted sustained on and off conditions.

Clicker switches have several advantages that have made them come into wide use, such as being very inexpensive and providing tactile feedback, i.e. a movement of the pushbutton that is felt by the person pressing the pushbutton for indicating that the switch mechanism has operated. In addition, clicker switches can have a "long stroke," i.e. the distance the pushbutton must be moved to actuate the switch can be relatively long so that it provides a definiteness of actuation and a good feel for a user.

Among the disadvantages of clicker-type switches is that they are relatively mechanically complex, having a spring-loaded rotating racheting mechanism, and so tend to be less reliable than is desired. While failure of the clicker ratcheting mechanism of a ball point pen that sells for much less than one U.S. dollar is of little concern because the pen can be easily and cheaply replaced, and such pen typically has no warranty, such is typically not the case when the ratcheting mechanism of a clicker switch of a flashlight fails.

Flashlights can be relatively expensive and so replacing a flashlight when its switch fails is not desirable. It is also undesirable that the reliability of a quality light be compromised by a cheap clicker switch. Repairing such flashlights can also be expensive and inconvenient, and can result in significant undesirable commercial effects for quality flashlights that are under a manufacturer's warranty or are sold under a trade mark that is recognized for a quality product.

In addition, where a flashlight is utilized by a person in certain businesses and professions, the failure of a light can be much more serious than an inconvenience. Particularly in the case of flashlights for use by police, fire, first responders, emergency personnel, military personnel, security personnel, and the like, expecting a flashlight or other appliance to operate when it fails to operate due to a switch failure could lead to life and property being placed at risk, if not to an injury, a loss of life and/or a destruction of property.

Accordingly, there is a need for a switch that can avoid the problems experienced with mechanical switches. It would be advantageous to have a flashlight that avoids certain problems experienced with mechanical switches.

According to a first aspect, an electrical switch may comprise a base having at least first, second and third electrical conductors thereon; a housing cover disposed adjacent the base and having walls defining a central cavity, and having an opening therethrough; an electrically conductive flexible dome disposed in the cavity of the housing cover, the flexible dome having a plurality of relatively longer legs extending from a dome portion thereof and being in electrical contact with the first electrical conductor of the base, the flexible dome having a relatively shorter leg extending from the dome portion thereof and overlying the second electrical conductor of the base, and the dome portion of the flexible dome overlying the third electrical conductor of the base, the flexible dome having an actuation distance, wherein the relatively shorter leg of the flexible dome comes into electrical contact with the second electrical conductor when the flexible dome is pressed with a first actuation force, and wherein the dome portion of the flexible dome comes into electrical contact with the third electrical conductor when the flexible dome is pressed with a second actuation force; a pushbutton disposed in the opening of the housing cover, wherein the pushbutton is movable in the opening of the housing cover for exerting force on the flexible dome via the spring and is urged away from the flexible dome; and at least one spring extending from the base for providing an electrical connection to at least one of the first, second and third electrical conductors of the base.

According to another aspect, an electrical switch may comprise: a housing cover having walls defining a central cavity and a non-circular base end, and having an opening to the central cavity for receiving a pushbutton; a generally planar base having a size and shape at least as large as the base end of the housing cover and having at least first, second and third electrical conductors thereon, wherein the base end of the housing cover is affixed to the base, and wherein the first, second and third electrical conductors are at least in part within a region defined by the non-circular base end of the housing cover; an electrically conductive flexible dome disposed in the central cavity of the housing cover at the non-circular base end thereof and abutting the base, the flexible dome having a plurality of relatively longer legs extending from a dome portion thereof to electrically contact the first electrical conductor of the base, the flexible dome having a relatively shorter leg extending from the dome portion thereof and overlying the second electrical conductor of the base, the dome portion of the flexible dome overlying the third electrical conductor of the base, wherein the flexible dome engages the non-circular base end of the housing cover for fixing its position relative to the housing cover and the base, and wherein the flexible dome has an actuation distance, wherein the relatively shorter leg of the flexible dome comes into electrical contact with the second electrical conductor when the flexible dome is pressed with a first actuation force, and wherein the dome portion of the flexible dome comes into electrical contact with the third electrical conductor when the flexible dome is pressed with a second actuation force; a pushbutton disposed in the opening of the housing cover and movable therein; a coil spring in the cavity of the housing cover having a first end bearing against the flexible dome and having a second end bearing against the pushbutton; wherein the pushbutton is movable in the opening of the housing cover for applying force to the flexible dome via the coil spring and is urged away from the flexible dome by the coil spring, wherein the coil spring has a spring rate selected so that the pushbutton must be moved over a distance that is substantially greater than the actuation distance of the flexible dome in order to produce the second actuation force on the flexible dome.

According to a further aspect, an electrical flashlight may comprise: a housing having a head end and a tail end and having a cavity for receiving a battery; an electrical light source disposed proximate the head end of the housing; and a pushbutton switch disposed on the housing for providing switch contacts, wherein the pushbutton switch includes an electrically conductive flexible dome having a plurality of relatively longer legs extending from a dome portion thereof, a relatively shorter leg extending from the dome portion thereof, wherein the relatively shorter leg of the flexible dome closes a first normally open switch contact of the switch contacts when the flexible dome is pressed with a first actuation force, and wherein the dome portion of the flexible dome closes a second normally open switch contact of the switch contacts when the flexible dome is pressed with a second actuation force; a controller disposed in the housing and electrically connected to the electrical light source and to the battery when a battery is provided in the cavity of the housing for selectively coupling electrical power from the battery to the electrical light source, wherein the controller is electrically connected to the pushbutton switch and is responsive to closure, or opening, or both, of the switch contacts thereof for controlling electrical power to the electrical light source at least for selectively energizing and de-energizing the electrical light source when the battery is present in the cavity of the housing.

BRIEF DESCRIPTION OF THE DRAWING

The detailed description of the preferred embodiment(s) will be more easily and better understood when read in conjunction with the FIGURES of the Drawing which include:

FIG. 2 is an exploded isometric view of the example embodiment of the plural pole electrical switch of FIG. 1;

Figure 1A:
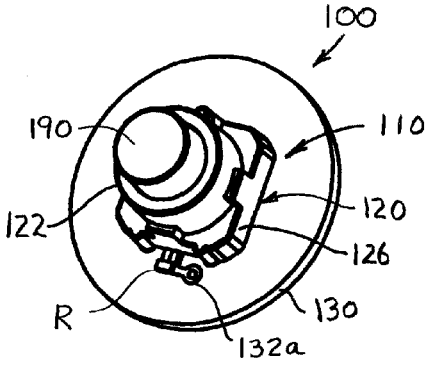
FIG. 1 includes FIGS. 1A and 1B which are isometric views of an example embodiment of a plural pole electrical switch wherein different external contact arrangements suitable for different utilizations are illustrated.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

An electrical switch according to the present arrangement desirably provides plural sequential switching functions that are actuated via a pushbutton that can provide a relatively long stroke and can provide tactile feedback confirming its actuation. By a relatively long stroke is meant that the movement of the actuating button that is required to fully actuate all of the switch functions of the electrical switch is substantial, e.g., in relation to the size of switch.

In other words, the distance the actuator must travel (the "stroke") to actuate the switching elements of the switch may be substantially longer than is the actual distance that the switch elements must travel to be actuated, e.g., by about two times or more. The feature of providing a long stroke may be considered desirable because providing a significant distance of travel for actuation of a switch can provide a user of the switch with a perception that he may more easily control actuation, whereas the user might not feel in control over the small distance actually needed to actuate the switch elements. Long stroke may also be referred to as an extended stroke or enlarged stroke.

The feature of providing tactile feedback may be considered desirable in providing a perception of switch actuation to a user of the switch, so that the user might be able to "feel" or perceive the actuation of the switch elements, and thereby feel more in control of switch operation.

FIG. 1 includes FIGS. 1A and 1B which are isometric views of an example embodiment of a plural pole electrical switch 100 wherein different external contact arrangements suitable for different utilizations are illustrated. Electrical switch 100 comprises a housing 110 including a base 130 and a housing cover 120 that fits on base 130 preferably to define a substantially closed cavity therein. Actuation pushbutton 190 extends from a generally cylindrical section 122 of housing 110 in which it is movable toward and away from housing base 130 for actuating a switch element or elements within housing 110. Housing cover 120 may have a rectangular lower section 126 defining a generally rectangular cavity in which the switch element or elements may be disposed.

Electrical connections to the contacts (poles) of switch elements internal to switch 100 may be made via electrical leads of a first switch pole and of a second switch pole that, for example, extend outward from switch 100 on or through housing base 130 in a desired direction, e.g., via electrical conductors that may be on or that pass through base 130 and/or via contact members that may extend from base 130. Examples of such contact members are described herein below, although other examples such as electrical wires and cables, may be apparent to one of skill in the electrical arts.

Typically, the switch poles provided at electrical leads of switch 100 are electrically insulated from each other and are actuated at different positions of and at different loads or forces applied to pushbutton 190, as is described below. Pushbutton 190 is preferably relatively long so that it has substantial travel distance outside of cylindrical section 122 of housing 110 so as to provide a relatively long stroke for operation.

Preferably, and typically, base 130 is a generally planar substrate of an electrically insulating material on which are provided electrical conductors in a desired pattern. This pattern of electrical conductors includes portions that cooperate with a switch element internal to switch 100 to provide the poles (contacts) thereof, and may also provide connection to electrical components of various types and kinds that might be mounted to base 130, e.g., such as an electrical component R illustrated. Examples of electrical components that may be mounted on base 130 and inter connected by electrical conductors thereon may include resistors, inductors, capacitors, diodes, transistors, integrated circuits, electro-optical devices, and the like.

Base 130 may be, e.g., an electrical printed wiring circuit board, and may have a substrate of, e.g., fiberglass epoxy, FR4, polyimide, ceramic, glass or other suitable electrical insulator, on which are formed electrical conductors of, e.g., copper, aluminum, silver, gold, tin, nickel, or another electrically conductive material, or a combination thereof.

The peripheral shape of base 130 may be of any desired shape and size so that switch 100 may conveniently be made compatible with any device into which switch 100 may be intended to be employed. In addition, base 130 may be, and often is, made larger than the size necessary to cooperate with housing 120 and the elements therein to provide the switch 100 per se. For example, base 130 may be of a size suitable to have an electrical circuit, such as all or part of the electrical circuit illustrated in FIGS. 4A and 4B, thereon. The electrical circuit that may be provided on base 130 may cooperate with switch 100 for providing a function, or may be separate from and unrelated to switch 130, or may in part cooperate with switch 130 and in part be separate from switch 130. Base 130 could be smaller in size than housing cover 120, if desired.

Electrical switch 100 of FIG. 1A includes an example base 130 that has a generally circular periphery as might be desired where switch 100 is intended to be mounted into a circular cavity, e.g., a circular bore, or a circular recess, or a tail cap or other part of a flashlight housing. Base 130 may include, e.g., one or more electrical components, such as electrical component R, mounted thereon and may have one or more contacts 132*a*, 134*a*, such as a pad or hole of electrically conductive material, to which an external connection may be made, e.g., by a wire, spring, metal part or the like.

Electrical switch 100 may include an external contact arrangement having contact member 260 comprising a spring 260 (not visible in FIG. 1A, visible in FIGS. 2 and 3A) extending from the surface of base 130 opposite the surface on which housing 120 is disposed. Such spring contact 260 may be suitable for a utilization such as in a flashlight wherein it may be desired to make an electrical connection with a source of electrical power, e.g., a battery, and may have an end (tail) connected at connection point 134*a*, e.g., by soldering or by other suitable means. Connection point 132*a* may provide an electrical connection through base 130, e.g., to a contact on the opposite surface thereof, such as a generally circular conductor 135.

Figure 4A:
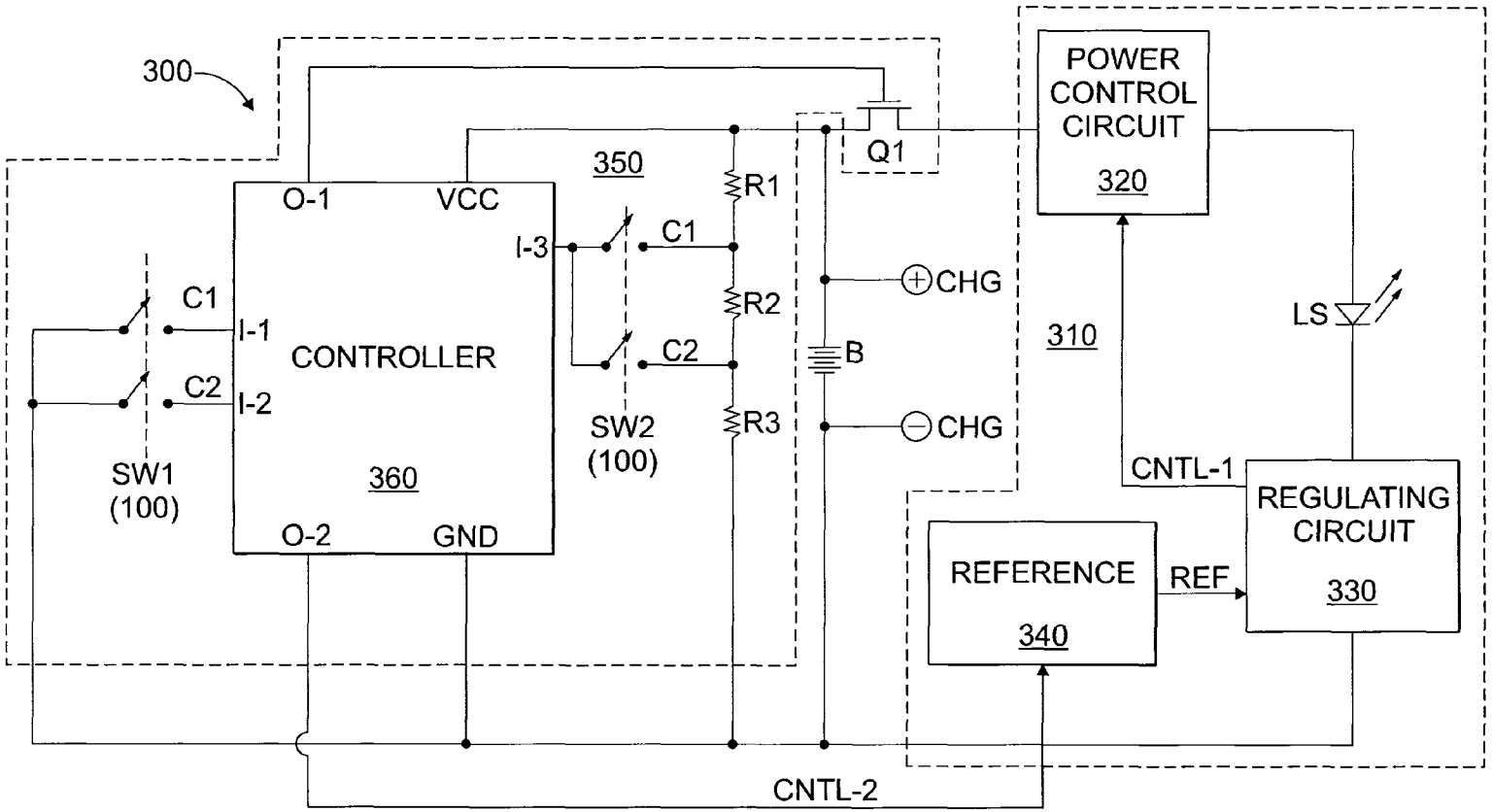
FIG. 4 includes FIGS. 4A and 4B which are electrical schematic diagrams illustrating example utilizations of the example plural pole electrical switch of FIGS. 1, 2 and 3.
Figure 4B:
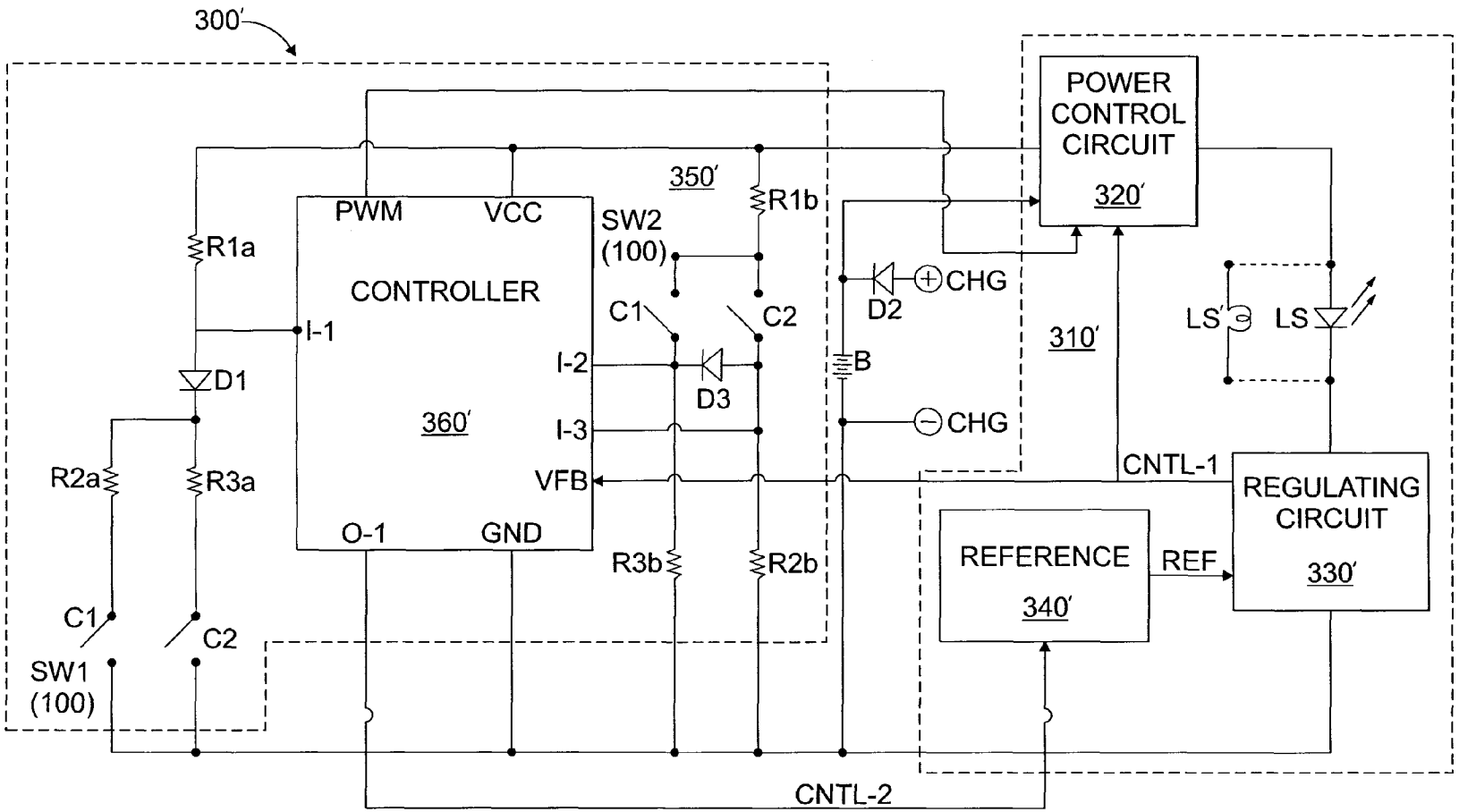

In certain applications, base 130 and the conductors, contact members and electrical components thereon comprise or may be part of an electrical circuit, such as all or part of the electrical circuit illustrated in FIGS. 4A and 4B.

Electrical switch 100 of FIG. 1B includes an example base 130' that has a generally rectangular periphery as might be desired where switch 100 is intended to be mounted into a rectangular cavity, e.g., a rectangular box or housing, or into a cylindrical bore or recess of a flashlight housing in an orientation generally parallel to the axis of symmetry of the bore or recess. In the example illustrated, switch module 200 includes first and second housing halves 210, 220, which are referred to for convenience as top half housing 210 and a bottom half housing 220. Top half housing 210 and bottom half housing 220 may be joined together, e.g., by a press fit, by adhesive, by heat staking or by any suitable method. Each of half housings 210, 220 generally defines a half cylinder shape so as to define a generally cylindrical switch module 200 when joined together with switch 100 therebetween, e.g., with base 130' being disposed in a plane generally parallel to the central axis of cylindrical module 200.

Top half housing 210 may have openings 214 that align with and receive projections 224 of bottom half housing 220 when housing halves 210, 220 are joined together, e.g., with corner 216 proximate corner 226. Top half housing 210 typically has an opening 212 into which or through which pushbutton 190 may extend so that switch 100 may be operated (actuated) by pushing button 190 from external to switch module 200. Pushbutton 190 is actuatable through opening 212 in housing part 210 irrespective of whether it extends out of housing part 210 or is wholly or partly recessed in opening 212.

Base 130' in this example has plural electrical contacts 230, 240, 250 extending therefrom, e.g., in a direction generally parallel to the plane defined by base 130', which direction could be also described as axial or longitudinal relative to cylindrical module 200. Contacts 230, 240 are generally concentric helical springs 230, 240 such as might be utilized for making contact with the positive and negative terminals of a battery, e.g., as in a flashlight. One example battery to which springs 230, 240 may make contact has a central positive terminal that is surrounded by an annular or circular negative terminal.

Respective ends of springs 230, 240, 250 may typically be soldered or otherwise electrically connected to connection points on base 130', e.g., plated through electrically conductive holes or connection pads. Bottom housing 220 may have one or more openings for facilitating the connection of springs 230, 240, 250 to base 130', such as opening 222 through which an end of spring 240 may pass. In one embodiment, springs 230, 240, 250 are preferably conical helical springs that have their larger diameter ends proximate to base 130'.

In certain applications, base 130' and the conductors, contact members and electrical components thereon comprise or may be part of an electrical circuit, such as all or part of the electrical circuit illustrated in FIGS. 4A and 4B. Base 130' may include one or more electrical conductors such as wires 270 that extend from base 130' and switch 100, e.g., to another electrical component, part, device, or circuit. Such wires 270 are typically connected to conductors of base 130' by a suitable means, such as by soldering, and may be insulated wires or may be bare conductors with insulating sleeving thereon.

Figure 3A:
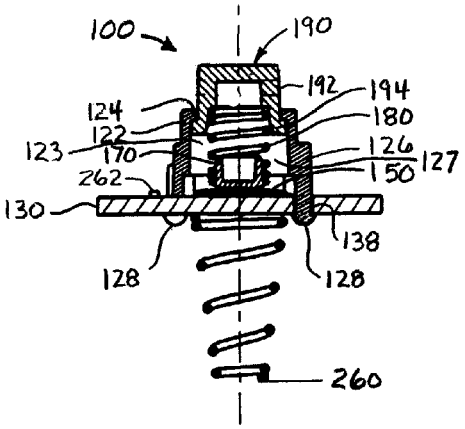
FIG. 3 includes FIGS. 3A and 3B which are cross-sectional views of the example embodiment of the plural pole electrical switch of FIGS. 1 and 2 and includes FIG. 3C which is a cross-sectional view of the example embodiment of the plural pole electrical switch of FIGS. 1 and 3A-3B.
Figure 3B:
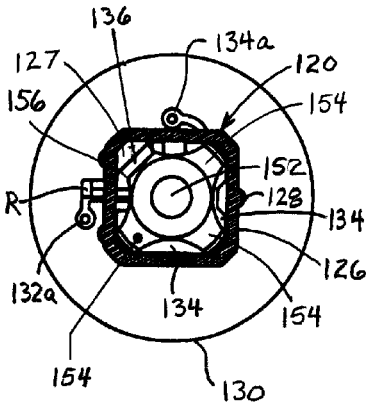
Figure 3C:
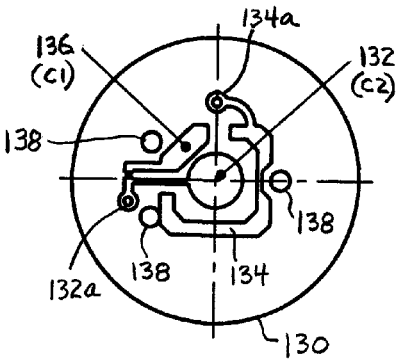

The internal arrangement of the example embodiment of an electrical switch 100 is now described by reference to the exploded isometric view thereof shown in FIG. 2, by reference to the cross-sectional view thereof shown in FIGS. 3A and 3B, and by reference to the plan view shown in FIG. 3C. Housing 110 comprises a base 130 and a housing cover 120. Base 130 is generally flat, e.g., planar. Housing cover 120 is mounted adjacent to base 130 to define a central region or cavity of housing 110 in which electrical switch element 102 therein may be provided. For example, housing 120 may have plural projections 128 extending therefrom and base 130 may have corresponding holes 138 into and through which projections 128 extend when housing 120 is properly positioned on base 130. Housing 120 may be secured on base 130 by peening or heat staking the ends of projections 128 so that they are larger in diameter than are holes 138. Alternatively, housing 120 may be secured by adhesive, screws, pins or other fasteners in holes 128 or by any other suitable means.

Switch element 102 comprises a flexible dome 150 that is disposed in the central cavity 127 of housing 120, typically with circuit board 130 adjacent thereto. Specifically, base 130 comprises a substrate having a pattern of electrical conductors thereon. The pattern of electrical conductors typically includes electrical conductors 134, 136 defining a peripheral conductor and a central electrical conductor 132 generally located centrally thereon, wherein electrical conductors 132, 134 and 136 typically are not electrically connected together on substrate 142 without an intervening electrical component. Longer peripheral conductor 134 connects to electrical connection 134*a* at a location on base 130 external to housing 120 and central conductor 132 connects to electrical connection 132*a* at a location external to housing 120. Shorter peripheral conductor 136 typically connects to electrical connection 132*a* via electrical component Rat a location external to housing 120. Longer peripheral conductor 134 typically encompasses less than about 270° of circular arc and shorter peripheral conductor 136 typically encompasses less than about 90° of circular arc. Each of connections 132*a*, 134*a* may comprise a plated-through hole into which an electrical conductor may be connected, e.g., by soldering or other suitable means.

Flexible dome 150 has a dome portion 152 (also referred to as "C2") and has a number of "legs" or "feet" 154, 156 extending therefrom, e.g., four feet 154, 156. In one example, three of the feet 154 are relatively longer and one of the feet 156 (also referred to as "C1") is relatively shorter. Flexible dome 150 is disposed adjacent to the circuit pattern of base 130 with the feet 154 of flexible dome 150 in electrical contact with peripheral conductor 134 of circuit base 130, e.g., at or near the corners thereof, thereby to provide normally-open single-pole switch element 102 having a first pole between longer peripheral conductor 134 and central conductor 132 and having a second pole between longer peripheral conductor 134 and shorter peripheral conductor 136.

Housing cover 120 defines a cavity 127 in which flexible dome 150 is disposed in an orientation with the longer legs 154 in contact with longer peripheral conductor 136 of base 130, with shorter leg 156 over shorter peripheral conductor 136, and with dome 152 over central conductor 132, Preferably, cavity 127 of housing cover 120 in non-circular so that the orientation of flexible dome 150 with respect to housing 120, and therefore with respect to base 130 is fixed, i.e. so that flexible dome 150 does not rotate so that legs 154, 156 depart from the desired relation with conductors 134, 136, respectively. In the example switch 100 illustrated, housing cover 120 defines a rectangular cavity 127 wherein each of legs 154, 156 tends to be in a corner of cavity 127 and is not free to rotate therein. Other shapes of cavity 127 could also be employed, e.g., a cylindrical cavity with respective radial recesses in which legs 154 are disposed.

When a sufficient force or load is applied to dome 152 of flexible dome 150, the relatively shorter leg 156 moves toward and makes contact with shorter peripheral conductor 136 thereby to close the switch contact C1 of switch element 102 after which the dome portion flexes (deflects) to come into electrical contact with central conductor 132 of circuit base 130, thereby to make electrical contact therewith and thereby to close the switch contact C2 of switch element 102 formed by circuit board 140 and flexible dome 150. When sufficient force or load is not applied to flexible dome 150, or when such force or load is reduced or removed, flexible dome 150 returns to its unflexed (relaxed, undeflected) domed shape and neither dome 152 nor leg 156 is in electrical contact with central conductor 146 and peripheral contact 136, respectively, thereby to open the contacts C2 and C1 of switch element 102 formed by circuit base 130 and flexible dome 150.

Flexible dome 150 typically is a metal dome and has a "snap" action in that it tends to resist flexing until a certain force (sometimes referred to as a trip force or an actuation force) is applied, and then it flexes (deflects) relatively suddenly or snaps; likewise, flexible dome 150 also tends to unflex (return, relax, undeflect) relatively suddenly or snap to return to its unflexed or relaxed shape or form. As a result, the sudden flexing and unflexing of flexible dome 150 may be felt via pushbutton 190 thereby to provide tactile feedback of the operation of switch element 102. The movement of relatively shorter leg 132 typically occurs at a lower level of force (e.g., 275 grams or about 0.6 pound) than does the flexing of dome 552 (e.g., 450 grams, or about one pound). As a result, contact C1 closes before contact C2 as actuating force is applied to dome 150 and contact C2 opens before contact C1 as actuating force is removed from dome 150.

Flexible dome 150 preferably flexes (deflects) at a relatively well defined force or load. For example, a flexible metal dome 150 having a 12 mm dome 152 may be provided that flexes (deflects) at a force of about 450 grams (about 1.0 lb.). Preferably, the flexing of dome 152 is relatively well defined in that it occurs relatively suddenly when the necessary level of force or load is applied so as to provide a tactile indication that flexing (deflection) has occurred.

Preferably, the force or load necessary to flex (deflect) shorter leg 156 of flexible dome 150 is less than the force necessary to flex (deflect) flexible dome 152 thereof so that when force or load is applied to the stack including plunger 170 and switch element 102, e.g., via spring 180, switch element C1 will actuate at a lower force or load than does switch element C2, thereby to provide an actuation sequence wherein switch contact C1 actuates (leg 156 flexes or deflects) before switch contact C2 actuates (dome 152 flexes or deflects) and a release sequence wherein switch contact C2 de-actuates (dome 152 unflexes or returns) prior to switch contact C1 de-actuating (shorter leg 156 unflexing or returning).

In practice, force or load applied to the stack of switch element 102, via pushbutton 190 and spring 180 is transmitted to flexible dome 150 of switch element 102 which tends to retain the shape of undeformed dome 152 of flexible dome 150. Thus, the actuation of switch element 102 is effected by the flexing of flexible dome 150 to move relatively shorter leg 156 thereof, and by the flexing of dome 152 to move, preferably suddenly, nearer to base 130. Typically, this action provides reduced or attenuated tactile feedback to a user upon actuation of contact C1 of switch element 102 because the force or load necessary to continue activation after contact C1 has actuated increases due to the higher force or load necessary to actuate contact C2 of switch element 102, but may not provide a perceived distinct snap. Typically, tactile feedback is provided at pushbutton 190 as a result of the snapping action of flexible dome 150 actuating switch contact C2.

Housing cover 120 is disposed adjacent base 130 to retain switch element 102 in cavity 139. Housing cover 120 has a section 122 extending therefrom having an opening or bore 123 in which a pushbutton 190 is movable. Preferably, at least the interior 123 of section 122 of housing cover 120 is cylindrical as is the exterior cylindrical section 192 of pushbutton 190. A spring 180, preferably a coil spring 180, is compressed between pushbutton 190 and plunger 170 which bears against flexible dome 152 of switch element 102 so as to urge pushbutton 190 away from switch element 102. Pushbutton 190 may have an optional recess or cavity 196 in the end thereof to receive spring 180.

Preferably, cylindrical section 122 of housing cover 120 has an inwardly extending feature, e.g., an inwardly extending flange or ring 124, extending inwardly into opening 123 and pushbutton 190 has an outwardly extending feature, e.g., an outwardly extending flange or ring 194, that engages the inwardly extending feature 124 of housing cover 120 so as to retain pushbutton 190 in the opening or bore 123 of housing cover 120. Typically, plunger 170 has a larger diameter portion adjacent flexible dome 150 defining a cylindrical section over which spring 180 slips to engage and bear against the outward flange or ring 174 of plunger 170.

Contact spring 260 extends from the broad surface of base 130 that is opposite the broad surface thereof on which housing 120 is mounted, and an end 262 of spring 260 typically extends through connection hole 132*a* and is electrically connected therein, e.g., by soldering. In one embodiment, spring 260 is a conical helical spring with its larger diameter end proximate to base 130.

In operation, switch 100 is actuated by force or load applied to pushbutton 190 in a direction that moves pushbutton 190 towards base 130 thereby tending to compress spring 180 and to exert force or load on switch element 102 via plunger 170. In the unactuated state, pushbutton 190 is moved away from switch element 102 by spring 180 so that flanges or rings 124, 194 of cover 120 and pushbutton 190, respectively, come into physical contact.

Pressing pushbutton 190 causes spring 180 to compress until the force spring 180 transmits to switch element 102 via plunger 170 increases to the level necessary to cause shorter leg 156 of flexible dome 150 to move so as to come into contact with peripheral conductor 136 of base 130. Because the force necessary to compress spring 180 is less than that necessary to flex (deflect) flexible dome 150, spring 180 compresses before flexible dome 150 actuates, i.e. at a lower force or load. This compression of spring 180 before switch element 102 actuates allows switch 100 to provide a relatively long stroke, i.e. pushbutton 190 moves a relatively long distance in actuating switch element 102, which is generally considered desirable for the user.

Because the force necessary to flex (deflect) dome 152 of flexible dome 150 is greater than that necessary to flex (deflect) dome 150 to move shorter leg 156 thereof, shorter leg 156 of flexible dome 150 moves (deflects) at a lower level of force so that switch contact C1 actuates before switch contact C2 of switch element 102. In practice, because of the relatively higher actuation force of flexible dome 152, flexible dome 152 provides a relatively rigid domed structure. It is believed that the force transmitted via spring 180 and plunger 170 to flexible dome 150 tends to cause flexible dome 150 to distort and thereby tend to move shorter leg 156 toward conductor 136 of base 130, and so the flexing of flexible dome 150 necessary for leg 156 thereof to make contact with conductor 166 of base 130 is less than that caused by the full force that would be necessary to cause flexible dome 150 to flex (deflect) to cause dome 152 to come into contact against conductor 132 of base 130. As a result, operation of switch element 102, i.e. to provide a closure of switch contact C1 between conductors 132 and 134 presents a relatively "soft" actuation without a strong tactile feedback.

As additional force is applied to pushbutton 190 beyond that necessary to actuate contact C1 of switch element 102, that force is transmitted via compressing spring 180 and plunger 170 and circuit board 160 to flexible dome 150 of switch element 102. Because the force necessary to compress spring 180 is less than that necessary to flex (deflect) dome 152 of flexible dome 150, spring 180 compresses before flexible dome 150 actuates, i.e. at a lower force. This compression of spring 180 before switch element 102 actuates allows switch 100 to provide a relatively long stroke, i.e. pushbutton 190 moves a relatively long distance in actuating switch element 102, which is generally desirable for the user.

When the full force necessary to cause flexible dome 150 to flex (deflect) dome 152 is applied to pushbutton 190 and transmitted via compressing spring 180 and plunger 170 to flexible dome 150, dome 152 of flexible dome 150 flexes (deflects) to come into contact with conductor 132 of base 130, thereby actuating contact C2 of switch element 102, i.e. to provide a closure of switch contact C2 between conductors 132 and 134. Dome 152 of flexible dome 150 typically flexes (deflects) with a snap action, thereby providing a definite tactile indication that contact C2 of switch element 102 has actuated.

De-actuation or release of switch 100 after full actuation is as follows. As the force applied to pushbutton 190 is reduced, deactivation of contacts C1, C2 of switch element 102 occurs in the reverse order to the actuation thereof as described above. Specifically, contact C2 de-actuates with dome 152 of flexible dome 150 returning to its unflexed or relaxed state with a snap action, thereby to break the electrical connection between electrical conductors 132 and 134, followed by contact C1 of switch element 102 de-actuating with short leg 156 of flexible dome 170 returning to its unflexed or relaxed state, thereby to break the electrical connection between electrical conductors 132 and 134. The distance over which pushbutton 190 moves in de-actuation of switch 100 is the same as the distance it moves in actuation, thereby providing a relatively long stroke.

A relatively long stroke may be provided through the cooperation of switch element 102 and spring 180, and in particular, the operating force levels of flexible dome 150 of switch element 102 relative to the spring rate of spring 180. Reducing the spring rate of spring 180 tends to increase the stroke or travel of pushbutton 190. It is generally desirable that actuation of contacts C1, C2 of switch element 102 be provided without the distal end of pushbutton 190 (e.g., the end of cylindrical section 192 distal flange 194) having to be pressed beyond the external end of cylindrical section 122 of housing 120. The material and thickness of flexible dome 150 and spring 180 may be selected for a desired actuation, e.g., the tactile feel of the actuation of switch element 102. Selected flexible domes 150 and springs 180 may be evaluated empirically to arrive at a desired actuation characteristic, e.g., a desired stroke distance and/or "feel."

In an example embodiment providing a long stroke, the mechanical travel to actuate flexible dome 150 of switch element 102 is only about 1.25 mm (about 0.05 inch), which is a very small distance for a human finger to move. However, the stroke or mechanical travel of pushbutton 190 needed to actuate switch element 102 is about 2.8 mm (about 0.11 inch), i.e. over about two times as long as the actual actuation travel of dome 152 of flexible dome 150.

Also for example, the force necessary to actuate (i.e. snap) dome 152 of flexible dome 150 is preferably greater than that necessary to actuate (move) shorter leg 156 of flexible dome 150. In one example, the force necessary to actuate dome 152 of flexible dome 150 is about 1¼ to two times or 2½ times that necessary to actuate (move) shorter leg 156 of flexible dome 150. For example, spring 180 is relatively long so as to allow for a correspondingly relatively long stroke and the spring constant of spring 180 may be selected, for example, and by way of approximation, to be equal to approximately the actuation force of dome 152 of flexible dome 150 divided by the total length of travel of pushbutton 180.

It is noted that switch 100 may be operated with less than full actuation, i.e. with less than actuation of both contacts C1, C2 of switch element 102. In particular, pushbutton 190 may be depressed sufficiently to actuate contact C1 of switch element 102, but not to actuate contact C2 thereof, which is thought to be relatively easier due to the relatively long stroke of the described arrangement. In such case, shorter leg 156 of flexible dome 150 makes contact with conductor 136 of base 130 thereby to provide a switch closure at contact C1 without any change of the open circuit condition of contact C2 between conductors 134 and 136 of base 130.

Typically, switch 100 could be mounted to an electronic and/or electrical circuit board including electronic and/or electrical circuits and/or components with which switch 100 cooperates for controlling certain functions. Alternatively, switch 100 could be connected via wires or other conductors to such circuits and/or components.

In one example embodiment, a switch 100 includes a 12 mm (about 0.5 inch) flexible dome 150 actuatable at shorter leg 156 at a force of about 275 grams (about 0.6 lb.) and at dome 152 at a force of about 450 grams (about 1.0 lb.) and an about 7.1 mm (about 0.28 inch) long spring 180 having a spring rate of about 170-190 grams/mm (about 9.5-10.5 lbs/inch). An example of such flexible dome is type DT-12450N available from Snaptron, Inc. located in Windsor, Colo. The force necessary to actuate contact C1 of switch element 102 was measured at about 275 grams (about 0.6 lb.) and the force necessary to by applied at pushbutton 190 actuate contact C2 of switch element 102 was measured at about 465 grams (about 1.0 lb.). The travel of pushbutton 190 to actuate contact C1 of switch element 102 was about 1.5 mm (about 0.06 inch) and the total travel of pushbutton 190 to actuate both contacts C1, C2 of switch element 102 was about 2.8 mm (about 0.11 inch). The maximum travel of pushbutton 190 is sufficiently longer than the actuation distance of spring 180 and flexible dome 150, including tolerances thereon, that actuation of flexible dome 150 will occur before pushbutton 190 reaches the end of its travel distance. Example switch 100 has a height of about 13.7 mm (about 0.54 inch).

Advantageously, the long stroke of the described example switch 100 and the distinctly different levels of force necessary to actuate contacts C1 and C2 of switch element 102 make it easy for a user to control the operation of switch 100 to actuate contact C1 104 or to actuate both contacts C1, C2 of switch elements 102. Thus, a user should be able to easily control the depressing of pushbutton 190 so as to actuate the function or functions controlled by Contact C1 or to actuate the function or functions controlled by contact C2 of switch element 102.

While both contacts C1, C2 of switch element 102 provide respective momentary single-pole switching operations, i.e. a single-pole electrical connection is made when the actuation button is pressed and the single-pole electrical connection is broken when the actuation pushbutton is released, and latching or other non-momentary operation maybe provided electronically as described below in relation to the circuits of FIGS. 4A and 4B, rather than by an unreliable mechanical ratchet as in conventional mechanical switch arrangements. As a result, both the "feel" of switch 100, including a long stroke and/or tactile feedback, and its control of operation of a flashlight or other apparatus, can be made to mimic that of a mechanical switch, e.g., a clicker switch, without incurring the disadvantages of a mechanical switch.

FIG. 4 includes FIGS. 4A and 4B which are electrical schematic diagrams illustrating example utilizations of the example plural pole electrical switch 100 of FIGS. 1, 2 and 3 in conjunction with an electronic control circuit 300, 300'. In FIG. 4A, example circuit 300 includes a light section 310 that selectively couples electrical energy from battery B to a light source LS for selectively producing light, and a control section 350 for energizing and controlling light section 310 and the light produced thereby. Battery B may be a rechargeable battery with charging energy supplied via charging circuitry (not shown), which may be external or internal to light 10, to battery charging terminals ⊕CHG and ⊖CHG.

Light producing section 310, when energized by the switching element, e.g., transistor Q1, being rendered conducting, operates as follows. Power control circuit 320 receives electrical energy from battery B at the battery potential (less a small voltage drop across conducting transistor Q1) and provides electrical energy at a desired voltage and/or current to light source LS. The voltage and/or current provided to light source LS is controlled or regulated to a desired value by regulating circuit 330, and regulating circuit 330 also provides a control signal CNTRL-1 to power control circuit 320 for controlling its operation. Control signal CNTRL-1 may be a signal of regulating circuit 330 that is related to the error between the level of current through light source LS and the reference signal REF, and may be a variable continuous signal or may be a pulse-width modulated signal.

Where light source LS is a solid state light source, such as a light-emitting diode (LED), regulating circuit 330 preferably controls the level of current flowing through LED light source LS. In a particular example, regulating circuit 330 regulates LED light source LS current to a level determined by a reference level REF provided by reference source 340. In other words, the level of current flowing in light source LS is directly related to the reference level REF by operation of regulating circuit 330, and power control circuit 320 preferably controls the voltage provided to light source LS to the lowest value suitable for the desired operation of light source LS and regulating circuit 330.

Closure of the respective contacts of contacts C1 and C2 of switch SW1 provides respective connections from, e.g., inputs I-1, I-2 of controller 360 to, e.g., the negative terminal of battery B which controller 360 detects as activation of contacts C1 and C2, respectively, of switch SW1. A voltage divider is formed by resistors R1, R2 and R3 being connected across battery B to provide different voltages at tap points at the connections of resistors R1, R2 and resistors R2, R3. Closure of the respective contacts C1 and C2 of switch SW2 provides respective connections from, e.g., different tap points of the resistor R1, R2, R3 voltage divider to, e.g., an input I-3 of controller 360 which controller 360 detects as activation of contacts C1 and C2, respectively, of switch SW2.

Each of switches SW1, SW2 connects to one or more inputs of controller 360 which responds to closures of the respective contacts C1 and C2 of switches SW1 and SW2 to render field-effect transistor Q1 conductive, i.e. into a low impedance conducting state, thereby to energize light section 310 and light source LS thereof, and to render transistor Q1 non-conductive, thereby to de-energize light section 310. Controller 360 receives its operating electrical power from battery B, either directly or via power control circuit 320, e.g., between terminals designated as VCC and GND.

In response to closure and/or opening of contacts C1, C2 of switches SW1, SW2, controller 360 may control various functions of a light or other load in accordance with the programming with which it is provided for detecting and acting on closures of switches SW1 and SW2. Controller 360 may comprise dedicated circuits 360 that have a fixed predetermined response to various switch SW1, SW2 closures, e.g., direct acting circuits such as an amplifier and/or a flip flop. Alternatively, controller 360 may comprise a controller or processor or digital processor that can provide a more sophisticated ability to interpret the closures of contacts of switches SW1 and SW2, e.g., in relation to time and/or frequency of switch closures as well as presence or absence of switch closures.

In one example embodiment, controller 360 may include a connection or a transistor or another switch that responds to closure of the C1 contact of either switch SW1 or switch SW2 to apply a driving signal via output O-1 to the control electrode of transistor Q1 for rendering transistor Q1 conductive. Transistor Q1 becoming conductive energizes light section 310 for light source LS to produce light so long as contact C1 of SW1 or SW2 provides connection. When contacts C1 of switches SW1 and SW2 are both open, transistor Q1 becomes non conductive and light source LS becomes de-energized. Thus, light source LS operates in a "momentary ON" mode in direct response to the closing of contact C1 of switch SW1 or of contact C1 of switch SW2 and in an "OFF" mode upon the opening of the respective contacts C1 of both switch SW1 and switch SW2.

Further, in that example, controller 360 may include a toggling type flip-flop that responds to closure of contact C2 of either switch SW1 or switch SW2 to toggle, e.g., alternate, between first and second states. In the first state, for example, transistor Q1 may be OFF and in the second state a driving signal may be applied to the control electrode of transistor Q1 for rendering transistor Q1 conductive. Transistor Q1 becoming conductive energizes light section 310 for light source LS to produce light so long as the flip-flop remains in the second state and to not produce light when the flip-flop toggles to the first state. Thus, light source LS toggles back and forth between a "continuous ON" state and an OFF state in response to the successive closings and openings of contact C2 of switch SW1 or of switch SW2.

In FIG. 4B, example circuit 300' includes a light section 310' that selectively couples electrical energy from battery B to a light source LS, LS' for selectively producing light, and a control section 350' for energizing and controlling light section 310' and the light produced thereby. Battery B may be a rechargeable battery with charging energy supplied via charging circuitry (not shown), which may be external or internal to light 10, to battery charging terminals ⊕ CHG and ⊖ CHG. Optionally, a diode, e.g., diode D2, may be provided to protect against a charger being connected with incorrect polarity.

Light producing section 310', when energized by the power control circuit 320' and regulating circuit 330' receives electrical energy from battery B at the battery potential or a greater potential VBOOST that provides electrical energy at a desired voltage and/or current to light source LS, LS'. The voltage and/or current provided to light source LS, LS' is controlled or regulated to a desired value by regulating circuit 330', and regulating circuit 330 also provides a control signal CNTRL-1, e.g., a voltage feedback signal, to input VFB of controller 360' for controlling the operation of reference circuit 340' and/or power control circuit 320'. Control signal CNTRL-1 may be a signal of regulating circuit 330' that is related to the level of current through light source LS, LS' which is set responsive to the reference signal REF, and may be a variable continuous signal or may be a pulse-width modulated signal.

Where light source LS is a solid state light source, such as a light-emitting diode (LED), regulating circuit 330 preferably controls the level of current flowing through LED light source LS. In a particular example, regulating circuit 330' regulates LED light source LS current to a level determined by a reference level REF provided by reference source 340'. In other words, the level of current flowing in light source LS is directly related to the reference level REF by operation of regulating circuit 330', and power control circuit 320 preferably controls the voltage provided to light source LS to the lowest value suitable for the desired operation of light source LS and regulating circuit 330'.

Where light source LS' is an incandescent lamp, such as a xenon, halogen or other lamp, regulating circuit 330' may control the level of current flowing through light source LS' or the voltage across light source LS' as may be desired. In a particular example, regulating circuit 330' may limit the maximum current flowing in light source LS' to a level considered safe and determined by a reference level REF provided by reference source 340' and power control circuit 320' may control the voltage VBOOST to a desired voltage. In other words, the level of current flowing in light source LS is limited responsive to the reference level REF by operation of regulating circuit 330', and power control circuit 320 preferably controls the voltage provided to light source LS' to the lowest value suitable for the desired operation of light source LS' and regulating circuit 330'. Where power control circuit 320' includes a voltage controlling circuit, e.g., a voltage boosting circuit, controller 360' may provide a pulse width modulated control signal PWM thereto for controlling the degree to which the battery voltage is increased, e.g., responsive to the voltage VBOOST.

A first voltage divider arrangement is formed by resistors R1*a* and R2*a* and by resistors R1*a* and R3*a* being connected across battery B when contacts C1 and/or C2 of switch SW1 are closed to provide different voltages at the junction of resistor R1*a* and diode D1 to the input I-1 of controller 360' to which controller 360' responds. When both contacts C1 and C2 of switch SW1 are open, the potential VCC is applied to input I-1 of controller 360. In similar manner, closure of the respective contacts C1 and C2 of switch SW2 provides respective connections from inputs I-2 and I-3 to VCC through resistor R1*b*, while providing voltage dividers of resistors R1*b* and R2*b* with respect to input I-3 and of resistors R1*b* and R3*b* with respect to input I-2 of controller 360' which controller 360, 360' detects as activation of contacts C1 and C2, respectively, of switch SW2. When contacts C1 and C2 of switch SW1 are open, the respective inputs I-1, I-2 of controller 360' are at the potential of the negative terminal of battery B, e.g., which may be considered as a local "ground" potential. If resistor R1*b* has a very low ohmic value or is a short circuit, then inputs I-2 and I-3 of controller 360' change from ground potential to almost VCC potential when contacts C1 and C2, respectively, of switch SW1 are closed. Optionally, a diode D3 may be provided to protect against controller 360' detecting closure of contact C2, but not of contact C1.

Each of switches SW1, SW2 connects to one or more inputs of controller 360' which responds to closures of the respective contacts C1 and C2 of switches SW1 and SW2 to render power control circuit 320' and/or regulating circuit 330' operative, thereby to energize light section 310' and light source LS, LS' thereof, and to render power control circuit 320' and/or regulating circuit 330' operative, thereby to de-energize light section 310'. Controller 360' receives its operating electrical power from battery B, via power control circuit 320', e.g., between terminals designated as VCC and GND.

In response to closure and/or opening of contacts C1, C2 of switches SW1, SW2, controller 360' may control various functions of a light or other load in accordance with the programming with which it is provided for detecting and acting on closures of switches SW1 and SW2. Controller 360' may comprise dedicated circuits 360' that have a fixed predetermined response to various switch SW1, SW2 closures, e.g., direct acting circuits such as an amplifier and/or a flip flop. Alternatively, controller 360' may comprise a controller or processor or digital processor that can provide a more sophisticated ability to interpret the closures of contacts of switches SW1 and SW2, e.g., in relation to time and/or frequency of switch closures as well as presence or absence of switch closures.

In one example embodiment, controller 360' may include a connection or a transistor or another switch that responds to closure of the C1 contact of either switch SW1 or switch SW2 to apply a driving signal to render power control circuit 320' and/or regulating circuit 330' operative, thereby energizing light section 310' for light source LS. LS' to produce light so long as contact C1 of SW1 or SW2 provides connection. When contacts C1 of switches SW1 and SW2 are both open, power control circuit 320' and/or regulating circuit 330' may become non operative and light source LS, LS' would become de-energized. Thus, light source LS, LS' operates in a "momentary ON" mode in direct response to the closing of contact C1 of switch SW1 or of contact C1 of switch SW2 and in an "OFF" mode upon the opening of the respective contacts C1 of both switch SW1 and switch SW2.

Further, in that example, controller 360' may include a toggling type flip-flop that responds to closure of contact C2 of either switch SW1 or switch SW2 to toggle, e.g., alternate, between first and second states. In the first state, for example, power control circuit 320' and/or regulating circuit 330' may be OFF and in the second state a driving signal may be applied to power control circuit 320' and/or regulating circuit 330' for rendering them operative. Power control circuit 320' and regulating circuit 330' becoming operative energizes light section 310' for light source LS, LS' to produce light so long as the flip-flop remains in the second state and to not produce light when the flip-flop toggles to the first state. Thus, light source LS, LS' toggles back and forth between a "continuous ON" state and an OFF state in response to the successive closings and openings of contact C2 of switch SW1 or of switch SW2.

In either or both of FIGS. 4A and 4B, the order in which power control circuit 320, 320', regulating circuit 330, 330' and light source LS, LS' are connected in series across battery B may be changed as may be necessary or desirable for any particular embodiment.

Example circuits for a light section 310, 310', for a power control 320, 320', for a regulating circuit 330, 330' and for a reference 340, 340' that are suitable for use in an example light including the present switch arrangement, and their operation, are described in U.S. patent application Ser. No. 11/335,486 filed Jan. 19, 2006, entitled "ELECTRONIC CIRCUIT REDUCING AND BOOSTING VOLTAGE FOR CONTROLLING LED CURRENT" which is assigned to the assignee of the present Application and which is hereby incorporated herein by reference in its entirety.

Control section 350, 350' energizes and controls light section 310, 310' responsive to operation of switches SW1 and SW2, each of which may be a switch 100 as described herein. For both switch SW1 and switch SW2, pole C1 may correspond to contact C1 of switching element 102 of switch 100 and pole C2 may correspond to contact C2 of switching element 102 of switch 100, each of which provides a momentary single-pole, single-throw (SPST) switch. In a switch 100 as described herein, increasing pressure on the pushbutton actuator thereof first causes contact C1 to close and further increasing pressure then causes contact C2 to close, and releasing some of the pressure results in contact C2 opening and further releasing of the pressure then results in contact C1 opening. Holding a pressure after contact C1 has closed and before contact C2 has closed results in contact C1 remaining closed until the pressure is released and in contact C2 not closing.

In a portable lighting device, such as a flashlight, switches SW1, SW2 may be located at different locations on the device, e.g., switch SW1 could be located towards the head, front or light producing end of the device 300, 300', and switch SW2 could be located towards the rear or non-light producing end of the device 300, 300', e.g., in a tail cap as a tail cap switch. A lesser or greater number of switches may be utilized in any particular device, and any switch or switches SW1, SW2 may have a greater number or a lesser number of contacts than that of the described example.

Even though contacts C1 and C2 of switches SW1 and SW2 are momentary SPST switches, controller 360, 360' provides the additional function of latching, e.g., transforming a momentary switch closure into a continuous action, as far as a user is concerned, until a subsequent switch closure occurs. Controller 360, 360' may similarly be configured to interpret the momentary switch closures as other types of functions, as may be convenient or desirable, thereby allowing additional features to be provided.

Additional features may be provided wherein controller 360, 360', rather than simply implementing a single function in response to a switch closure, includes a more complex controller or processor, e.g., such as a microprocessor or digital processor. In such embodiment, controller 360, 360' may be programmed to provide, for example, a momentary ON state, a continuous ON state, and an OFF state, of light source LS, LS' in response to closures and openings of contacts C1 and C2 of switches SW1 and SW2 in like manner to that described in the preceding paragraphs. In addition, controller 360, 360' may also be programmed to respond to other conditions of switches SW1, SW2, e.g., conditions based upon the number of actuations of a particular contact C1 and/or contact C2, the time between actuations of a particular contact C1 and/or contact C2, the time of continuous actuation of a particular contact C1 and/or contact C2, and/or combinations thereof. Further, a controller 360, 360' may be programmed to provide a response to actuation of switch SW1 that differs from an identical actuation of switch SW2, or to a sequence of actuations according to which of switches SW1 and SW2 are actuated and the timing and ordering thereof.

In one example embodiment, a flashing light mode and a dimming mode may be provided by controller 360, 360'. For example, rapidly closing and opening contacts C1 and C2 of either switch SW1 or switch SW2 two times in quick succession (e.g., "double clicking" switch SW1 or SW2)

may be utilized to enter, for example, a flashing light state wherein light source LS, LS' alternates between producing light (ON) and not producing light (OFF) at a predetermined rate. In other words, quickly actuating either switch SW1 or switch SW2 within a short time period, e.g., within about 0.3 seconds, in a manner that would otherwise cause the light to enter or exit a continuous ON state, causes the light to operate in a flashing mode, with light source LS, LS' flashing ON and OFF, e.g., at an about 12 Hz or other desired rate.

The flashing of light source LS, LS' may be provided in any one of several ways. In circuit 300, for example, controller 360 may cause its output O-1 to alternate between the ON and OFF levels at the predetermined flashing rate so that transistor Q1 alternates between conductive and non-conductive conditions at the predetermined flashing rate, thereby to cause power control 320 and regulating circuit 330 to apply and remove power from light source LS at the predetermined flashing rate. Alternatively, controller 360 of circuit 300 may cause its output O-2 which controls reference source 340 to alternate between high and low levels at the predetermined flashing rate, and controller 360' of circuit 300' may cause its output O-1 which controls reference source 340' to alternate between high and low levels at the predetermined flashing rate. This modulates reference source 340, 340' to produce a reference signal REF that alternates between a high level and a very low level so that the current flowing in light source LS, LS', which is directly related to the level of signal REF, alternates between a high level and a very low level, thereby to flash light source LS, LS' at the predetermined flashing rate.

For a light dimming mode, for example, the closing both contacts C1 and C2 of either switch SW1 or of switch SW2 for an extended time (e.g., more than about one second) may be utilized to enter a light dimming mode wherein the current provided to light source LS is reduced during the time contacts C1 and C2 are both closed (after the initial extended time). If the extended time is about one second, then continuing to keep the switch SW1 or SW2 in its actuated condition after about one second has elapsed results in the light produced by light source LS diminishing. Thereafter, releasing switch SW1, SW2 causes the light level to remain at whatever level it is at at the time when switch SW1, SW2 is released. The dimming mode may be exited by again closing contacts C1 and C2 of either switch SW1 or SW2 in the manner for entering or leaving the continuous ON state.

The dimming of light source LS may be provided in any one of several ways. For example, controller 360 in circuit 300 may cause its output O-2 which controls reference source 340 to decrease at a predetermined rate during the time that SW 1 and/or SW2 is held closed, and controller 360' in circuit 300' may cause its output O-1 which controls reference source 340' to decrease at a predetermined rate during the time that SW 1 and/or SW2 is held closed. This modulates reference source 340, 340' to produce a reference signal REF that decreases from a high level towards a very low level at a predetermined rate so that the current flowing in light source LS, LS', which is directly related to the level of signal REF due to the regulating action of regulating circuit 330, 330', decreases from a high level towards a very low or zero level, thereby to dim light source LS, LS' at the predetermined rate, as is preferred.

Alternatively, for example, controller 360 of circuit 300 may provide dimming by causing its output O-2 to alternate between the high level and the low level in a pulse-width modulated manner and controller 360' of circuit 300' may provide dimming by causing its output O-1 to alternate between the high level and the low level in a pulse-width modulated manner, both at a frequency above that perceptible to the human eye so that the reference level REF alternates between the high level and the low level conditions at that frequency, thereby to cause reference source 340, 340' to pulse width modulate the value of the reference REF and cause regulating circuit 330, 330' to increase and decrease the light produced by light source LS, LS' at that frequency. The width of the pulse from output O-2 in circuit 300 and from output O-1 in circuit 300' changing reference REF for changing the current in light source LS, LS' decreases at a predetermined rate so that the light output from light source LS, LS', which is proportional to the average of the applied current, decreases at the predetermined rate. Alternatively, and preferably, reference source 340, 340' may include a low-pass filter, e.g., a capacitor, for filtering the pulse-width modulated signal from output O-2 of controller 360 and from output O-2 of controller 360' so that reference signal REF is proportional to the average thereof, thereby to control the current in light source LS, LS' to be proportional to the average of the pulse-width modulated output O-2 in circuit 300 and of the pulse-width modulated output O-1 in circuit 300'.

Alternatively, for example, controller 360 of circuit 300 may provide dimming by causing its output O-1 to alternate between the ON level and the OFF level in a pulse-width modulated manner at a frequency above that perceptible to the human eye so that transistor Q1 alternates between conductive and non-conductive conditions at that frequency, thereby to cause power control 320 and regulating circuit 330 to apply and remove power from light source LS at that frequency. The width of the pulse from output O-1 via transistor Q1 applying power to light source LS decreases at a predetermined rate so that the light output from light source LS, which is proportional to the average of the applied current, decreases at the predetermined rate.

It is noted that the decreasing and increasing of the control signals may be made at any desired rate and increment size. For example, the increment (step) size may be made relatively coarse so that each step of dimming and un-dimming produces a change in the level of light produced by light source LS, LS' that is evident to human perception. Alternatively, the size of the increments (steps) may be made finer so that individual steps of dimming and un-dimming are not perceived, and so the dimming and un-dimming appears to be smooth and continuous, rather than a sequence of perceivable steps.

In a preferred dimming operating mode, the light produced by light source LS, LS' is controlled in the dimming mode by controller 360, 360' so that it does not extinguish, but maintains a relatively low-level of light output in response to the dimming actuation. Further, a preferred operation may be that, when switch SW1 or SW2 is actuated for a long time, the light output of light source LS first decreases to a relatively low level at the predetermined rate and then reverses and increases towards the normal light output at the predetermined rate, and continues alternatingly decreasing and increasing between the normal light level and the relatively low light level, so long as a switch SW1 or SW2 is maintained in the actuated condition with contacts C1 and C2 closed. In a preferred operation, the increasing and decreasing of the light level of light source LS in the dimming mode may vary sinusoidally or in a sawtooth manner between the normal light level and the relatively low light level, e.g., at about four seconds per sinusoidal or sawtooth cycle.

Control of the light level produced by light source LS in the dimming mode is preferable provided by the output O-2 of controller 360 or by the output O-1 of controller 360' varying between a maximum value and a minimum value. While such controller output O-2, O-1, respectively, could be varied in an analog or continuous manner, thereby to cause reference signal REF to vary in a corresponding continuous manner, it is preferred that such controller output be a pulse-width modulated signal that varies between a maximum (e.g., 100%) on-time pulse width modulated signal corresponding to normal light output and a minimum on-time corresponding to the relatively low level light output (e.g., about 25% duty cycle). The discontinuous nature of this signal at such controller output is preferably low-pass filtered in reference circuit 340, 340', e.g., by a capacitor therein. Typically, the signal at such controller output is pulse width modulated at about 50 KHz.

In the event that it might be desired to pulse-width modulate the current to light source LS, LS', e.g., to not filter the reference potential in reference circuit 340, 340', then the frequency of the pulse-width modulated signal preferably should be above a frequency at which, absent the capacitor, pulsing of light source LS, LS' output would be perceived by a human, e.g., above about 80-100 Hz.

At any point in the dimming cycle, release of switch SW1, SW2 causes the changing of the light output of light source LS, LS' to cease and maintains the then-present level of light output. The dimming mode of operation may be exited by depressing and releasing switch SW1 or SW2 to close and then open contacts C1 and C2 thereof in the manner for entering or exiting the continuous ON condition.

Controller 360, 360', whether a digital processor/controller or another controller, may be programmed to respond to closures of the respective contacts C1, C2 of switches SW1 and SW2 in any desired manner and to provide any desired function or feature. By way of another example, in addition to momentary ON, continuous ON and OFF responses as described above, controller 360, 360' could respond to closure of contact C1 of either SW1 or SW2 when light 100 is in the continuous ON state to provide a change in the brightness of the light produced. This dimming action could be in response to successive closures of a contact C1 to produce successive increments of changed brightness or could be in response to the time that a contact C1 is held closed. Increments of brightness change could be provided in any desired increment size, whether each increment is sufficiently large to be perceived by a human or not. Brightness change could be monotonic in that brightness dimming stops at a predetermined minimum brightness, which could include no light output, or could repetitively cycle down and up in brightness similar to that described above.

By way of another example, controller 360, 360' could interpret two quick contact and release sequences of both contacts C1 and C2 of SW1 or SW2, i.e. "double clicking," to enter a flashing light operation, or could respond to the number of such closures and/or the duration thereof to select one or more light sources to be energized from among plural light sources, or to select light sources of differing colors, or any other function that may be desired.

Typically, control circuit 300, 300' could be provided on a circuit board to which one or more switches 100 are mounted, e.g., such as a circuit board of base 130 or 130', or by connecting leads or wires to connection holes therein or connection pads thereon, or on a circuit board to which one or more switches 100 are connected, e.g., by leads or wires, or by a combination thereof, and such circuit board could be disposed at any convenient location in a flashlight or other appliance utilizing circuit 300, 300'. In one example embodiment, a circuit board including at least a substantial part of circuit 300, 300' is disposed in a flashlight housing 300, 300' close behind the light source LS and the reflector in which it is disposed, and forward of the battery B cavity. One switch 100, e.g., switch SW1 or SW2, may be disposed on the flashlight housing 300, 300' in a relatively forward location and the other switch 100, e.g., the other of switch SW2 or SW1, may be disposed relatively rearward, such as in a tail cap.

An electrical switch 100 may comprise: a base 130, 130' having at least first and second peripheral electrical conductors 134, 136 and a central electrical conductor 132 thereon; an electrically conductive flexible dome 150 disposed on base 130, 130', flexible dome 150 having a plurality of relatively longer legs 154 extending from dome portion 152 thereof and being in electrical contact with the first peripheral electrical conductor 132 of base 130, 130', flexible dome 150 having a relatively shorter leg 156 extending from dome portion 152 thereof and overlying the second peripheral electrical conductor 136 of base 130, 130', and flexible dome 150 having dome portion 152 overlying the central electrical conductor of base 130, 130', flexible dome 150 having an actuation distance; wherein the relatively shorter leg 156 of flexible dome 150 comes into electrical contact with the second electrical conductor 136 of base 130, 130' when flexible dome 150 is pressed towards base 130, 130' with a first actuation force, and wherein dome portion 152 of flexible dome 150 comes into electrical contact with the central electrical conductor 132 of base 130, 130' when flexible dome 150 is pressed towards base 130, 130' with a second actuation force that is greater than the first actuation force; a spring 180 having a first end bearing against flexible dome 150 and having a second end; an actuation pushbutton 190 disposed at the second end of spring 180, wherein actuation pushbutton 190 is urged away from flexible dome 150 by spring 180, wherein actuation pushbutton 190 is movable for applying force to flexible dome 150 via spring 180, and wherein spring 180 has a spring rate selected so that actuation pushbutton 190 must be moved over a distance that is substantially greater than the actuation distance of flexible dome 150 in order to produce the second actuation force on flexible dome 150. Spring 180 may have a length that is substantially longer than the actuation distance of flexible dome 150. Electrical switch 100 may further comprise a housing cover 120 disposed adjacent base 130, 130', housing cover 120 having walls defining a central cavity, and having an opening therethrough in which actuation pushbutton 190 is movable, wherein flexible dome 150 and spring 180 are disposed in the cavity of housing cover 120, and wherein electrical connections to the central and peripheral electrical conductors 132, 134, 136 of base 130, 130' are made by electrical conductors on base 130, 130', by electrical conductors extending from base 130, 130', or by electrical conductors on and extending from base 130, 130'. At least one spring 230, 240, 260 may extend from base 130, 130' for providing an electrical connection to at least one of the central electrical conductor 132, the first peripheral electrical conductor 134, and the second peripheral electrical conductor 136 of base 130, 130'. Spring 230, 240, 260 may include two concentric springs 230, 240 extending in a direction generally parallel to a plane defined by base 130, 130'. Electrical switch 100 may further comprise first and second housing parts 210, 220 defining a generally cylindrical module 200, wherein base 130, 130' of electrical switch 100 is disposed between first and second housing parts 210, 220 with two concentric springs 230, 240 extending axially from the generally cylindrical module 200 and with actuation pushbutton 190 actuatable through an opening in first housing part 210. Electrical switch 100 may be in combination with a controller 360, 360' and a load 310, 310', wherein controller 360, 360' may be responsive to the relatively shorter leg of flexible dome 150 making connection between the first and second peripheral electrical conductors of base 130, 130', to dome portion 152 of flexible dome 150 making connection between the central conductor and the first peripheral electrical conductor of base 130, 130', to dome portion 152 of flexible dome 150 breaking connection between the central conductor and the first peripheral electrical conductor of base 130, 130', to the relatively shorter leg of flexible dome 150 breaking connection between the first and second peripheral electrical conductors of base 130, 130', or to any combination of the foregoing, for controlling the load 310, 310'. Controlling the load 310, 310' may include energizing the load 310, 310' momentarily, energizing the load 310, 310' continuously, de-energizing the load 310, 310', causing the load 310, 310' to alternate repetitively between energized and de-energized conditions, causing the load 310, 310' to change from a more energized condition to a less energized condition, causing the load 310, 310' to change from a less energized condition to a more energized condition, or any combination of the foregoing. Load 310, 310' may include electrical light source LS, LS', and controller 360, 360' may control the light source LS, LS' to momentary ON, continuous ON, OFF, flashing, and dimming operating conditions, and optionally to an un-dimming operating condition.

An electrical switch 100 may comprise: a base 130, 130' having at least first, second and third electrical conductors 132, 134, 136 thereon; a housing cover 120 disposed adjacent base 130, 130', housing cover 120 having walls defining a central cavity 123, 127, and having an opening 123 therethrough; an electrically conductive flexible dome 150 disposed in the cavity 127 of housing cover 120, flexible dome 150 having a plurality of relatively longer legs 154 extending from dome portion 152 thereof and being in electrical contact with the first electrical conductor 134 of base 130, 130', flexible dome 150 having a relatively shorter leg 156 extending from dome portion thereof and overlying the second electrical conductor 136 of base 130, 130', and flexible dome 150 having dome portion 152 overlying the third electrical conductor 132 of base 130, 130', flexible dome 150 having an actuation distance, wherein the relatively shorter leg 156 of flexible dome 150 comes into electrical contact with the second electrical conductor 136 when flexible dome 150 is pressed with a first actuation force, and wherein dome portion 152 of flexible dome 150 comes into electrical contact with the third electrical conductor 132 when flexible dome 150 is pressed with a second actuation force; a spring 180 in the cavity between base 130, 130' and housing cover 120, spring 180 having a first end bearing against flexible dome 150 and having a second end; a pushbutton 190 disposed in the opening of housing cover 120 at the second end of spring 180, wherein pushbutton 190 is movable in the opening 123 of housing cover 120 for exerting force on flexible dome 150 via spring 180 and is urged away from flexible dome 150 by spring 180, wherein spring 180 has a spring rate selected so that pushbutton 190 must be moved over a distance that is substantially greater than the actuation distance of flexible dome 150 in order to produce the second actuation force on flexible dome 150. Spring 180 may have a length that is substantially longer than the actuation distance of flexible dome 150. Base 130, 130' may be larger than housing cover 120 disposed thereon, and electrical connections to the first, second and third electrical conductors 132, 134, 136 of base 130, 130' may be made by electrical conductors on base 130, 130', by electrical conductors extending from base 130, 130', or by electrical conductors on and extending from base 130, 130'. At least one spring 230, 240, 260 may extend from base 130, 130' for providing an electrical connection to at least one of the first, second and third electrical conductors 132, 134, 136 of base 130, 130'. Spring 230, 240, 260 may include two concentric springs 230, 240 extending in a direction generally parallel to a plane defined by base 130, 130'. Electrical switch 100 may further comprise first and second housing parts 210, 220 defining a generally cylindrical module 200, wherein base 130, 130' may be disposed between first and second housing parts 210, 220 with two concentric springs 230, 240 extending axially from the generally cylindrical module 200 and with pushbutton 190 actuatable through an opening in first housing part 210. Electrical switch 100 may be in combination with a controller 360, 360' and a load 310, 310', wherein controller 360, 360' may be responsive to the relatively shorter leg 156 of flexible dome 150 making connection between the first and second peripheral electrical conductors 134, 136 of base 130, 130', to dome portion 152 of flexible dome 150 making connection between the central conductor 132 and the first peripheral electrical conductor 134 of base 130, 130', to dome portion 152 of flexible dome 150 breaking connection between the central conductor 132 and the first peripheral electrical conductor 134 of base 130, 130', to the relatively shorter leg 156 of flexible dome 150 breaking connection between the first and second peripheral electrical conductors 134, 136 of base 130, 130', or to any combination of the foregoing, for controlling the load 310, 310'. Controlling load 310, 310' may include energizing the load 310, 310' momentarily, energizing the load 310, 310' continuously, de-energizing the load 310, 310', causing the load 310, 310' to alternate repetitively between energized and de-energized conditions, causing the load 310, 310' to change from a more energized condition to a less energized condition, causing the load 310, 310' to change from a less energized condition to a more energized condition, or any combination of the foregoing. Load 310, 310' may be an electrical light source LS, LS', and controller 360, 360' may control the light source LS, LS' to momentary ON, continuous ON, OFF, flashing, and dimming operating conditions, and optionally to an un-dimming operating condition.

An electrical switch 100 may comprise: a housing cover 120 having walls defining a central cavity 123, 127 and a non-circular base end 126, and having an opening 123 to the central cavity 123, 127 for receiving a pushbutton 190; a generally planar base 130, 130' having a size and shape at least as large as the base end 126 of housing cover 120 and having at least first, second and third electrical conductors 132, 134, 136 thereon, wherein the base end 126 of housing cover 120 is affixed to base 130, 130', and wherein the first, second and third electrical conductors 132, 134, 136 are at least in part within a region defined by the non-circular base end 126 of housing cover 120; an electrically conductive flexible dome 150 disposed in the central cavity of housing cover 120 at non-circular base end 126 thereof and abutting base 130, 130', flexible dome 150 having a plurality of relatively longer legs 154 extending from dome portion 152 thereof to electrically contact the first electrical conductor 134 of base 130, 130', flexible dome 150 having a relatively shorter leg 156 extending from dome portion 152 thereof and overlying the second electrical conductor 136 of base 130, 130', dome portion 152 of flexible dome 150 overlying the third electrical conductor 132 of base 130, 130', wherein flexible dome 150 engages the non-circular base end 126 of housing cover 120 for fixing its position relative to housing cover 120 and base 130, 130', and wherein flexible dome 150 has an actuation distance, wherein the relatively shorter leg 156 of flexible dome 150 comes into electrical contact with the second electrical conductor 136 when flexible dome 150 is pressed with a first actuation force, and wherein dome portion 152 of flexible dome 150 comes into electrical contact with the third electrical conductor 132 when flexible dome 150 is pressed with a second actuation force; a pushbutton 190 disposed in the opening 123 of housing cover 120 and movable therein; a coil spring 180 in the cavity 123, 127 of housing cover 120 having a first end bearing against flexible dome 150 and having a second end bearing against pushbutton 190; wherein pushbutton 190 is movable in the opening 123 of housing cover 120 for applying force to flexible dome 150 via coil spring 180 and is urged away from flexible dome 150 by coil spring 180, wherein coil spring 180 has a spring rate selected so that pushbutton 190 must be moved over a distance that is substantially greater than the actuation distance of flexible dome 150 in order to produce the second actuation force on flexible dome 150. The spring rate of coil spring 180 may be such that pushbutton 190 must be moved in the opening 123 of housing cover 120 over a distance that is at least the actuation distance of flexible dome 150 for producing the first actuation force on flexible dome 150. Electrical switch 100 may be in combination with a controller 360, 360' and a load 310, 310', wherein controller 360, 360' may be responsive to the relatively shorter leg 156 of flexible dome 150 making connection between the first and second peripheral electrical conductors 134, 136 of base 130, 130', to dome portion 152 of flexible dome 150 making connection between the central conductor 132 and the first peripheral electrical conductor 134 of base 130, 130', to dome portion 152 of flexible dome 150 breaking connection between the central conductor 132 and the first peripheral electrical conductor 134 of base 130, 130', to the relatively shorter leg 156 of flexible dome 150 breaking connection between the first and second peripheral electrical conductors 134, 136 of base 130, 130', or to any combination of the foregoing, for controlling the load 310, 310'. Controlling the load 310, 310' may include energizing the load 310, 310' momentarily, energizing the load 310, 310' continuously, de-energizing the load 310, 310', causing the load 310, 310' to alternate repetitively between energized and de-energized conditions, causing the load 310, 310' to change from a more energized condition to a less energized condition, causing the load 310, 310' to change from a less energized condition to a more energized condition, or any combination of the foregoing. Load 310, 310' may be an electrical light source LS, LS', and controller 360, 360' may control the light source LS, LS' to momentary ON, continuous ON, OFF, flashing, and dimming operating conditions, and optionally to an un-dimming operating condition.

An electrical flashlight 300, 300' may comprise: a housing having a head end and a tail end and having a cavity for receiving a battery B; an electrical light source LS, LS' disposed proximate the head end of housing; and a first pushbutton switch 100 disposed proximate the head end of the housing for providing first switch contacts C1, C2, wherein first pushbutton switch 100 includes a first electrically conductive flexible dome 150 having a plurality of relatively longer legs 154 extending from dome portion 152 thereof, a relatively shorter leg 156 extending from dome portion 152 thereof, wherein the relatively shorter leg 156 of second flexible dome 150 closes a first normally open switch contact C1 of the first switch contacts C1, C2 when second flexible dome 150 is pressed with a first actuation force, and wherein dome portion 152 of second flexible dome 150 closes a second normally open switch contact C2 of the first switch contacts C1, C2 when second flexible dome 150 is pressed with a second actuation force; a second pushbutton switch 100 disposed proximate the tail end of housing for providing second switch contacts C1, C2, wherein second pushbutton switch 100 includes a second electrically conductive flexible dome 150 having a plurality of relatively longer legs 154 extending from dome portion 152 thereof, a relatively shorter leg 156 extending from dome portion 152 thereof, wherein the relatively shorter leg 156 of second flexible dome 150 closes a first normally open switch contact C1 of the second switch contacts C1, C2 when second flexible dome 150 is pressed with a first actuation force, and wherein dome portion 152 of second flexible dome 150 closes a second normally open switch contact C2 of the second switch contacts C1, C2 when second flexible dome 150 is pressed with a second actuation force; a controller 360, 360' disposed in the housing and electrically connected to electrical light source LS, LS' and to the battery B when a battery is provided in the cavity of housing for selectively coupling electrical power from the battery B to electrical light source LS, LS', wherein controller 360, 360' is electrically connected to first pushbutton switch 100 and is responsive to closure, or opening, or both, of the first switch contacts C1, C2 thereof for controlling electrical power to electrical light source LS, LS' at least for selectively energizing and de-energizing electrical light source LS, LS' when the battery B is present in the cavity of housing, and wherein controller 360, 360' is electrically connected to second pushbutton switch 100 and is responsive to closure, or opening, or both, of the second switch contacts thereof C1, C2 for controlling electrical power to electrical light source LS, LS' at least for selectively energizing and de-energizing electrical light source LS, LS' when the battery B is present in the cavity of housing, whereby electrical light source LS, LS' of flashlight 300, 300' may be selectively energized and de-energized responsive to either or both of first and second pushbutton switches 100, 100 without electrical power to energize the light source LS, LS' flowing through the first and second pushbutton switches 100, 100. Either or both of first pushbutton switch 100 and second pushbutton switch 100 may further comprise: an actuator 190 movable for exerting force on the flexible dome 150 thereof via a spring 180, and for exerting force on the flexible dome 150 thereof via the spring 180, wherein actuator 190 moves a distance for closing the normally open contacts C1, C2 of flexible dome 150 thereof that is substantially longer than an actuating distance of the flexible dome 150 thereof. Controller 360, 360' may control electrical power to electrical light source LS, LS' for energizing electrical light source LS, LS' momentarily, for energizing electrical light source LS, LS' continuously, for de-energizing electrical light source LS, LS', for causing electrical light source LS, LS' to alternate repetitively between energized and de-energized conditions, for causing electrical light source LS, LS' to change from a more energized condition to a less energized condition, for causing electrical light source LS, LS' to change from a less energized condition to a more energized condition, or for any combination of the foregoing. Controller 360, 360' may control electrical light source LS, LS' to momentary ON, to continuous ON, to OFF, to flashing, and to dimming operating conditions, and optionally to an un-dimming operating condition.

An electrical switch may comprise: a base having at least first, second and third electrical conductors thereon; a housing cover disposed adjacent the base, the housing cover having walls defining a central cavity, and having an opening therethrough; an electrically conductive flexible dome disposed in the cavity of the housing cover, the flexible dome having a plurality of relatively longer legs extending from a dome portion thereof and being in electrical contact with the first electrical conductor of the base, the flexible dome having a relatively shorter leg extending from the dome portion thereof and overlying the second electrical conductor of the base, and the dome portion of the flexible dome overlying the third electrical conductor of the base, the flexible dome having an actuation distance, wherein the relatively shorter leg of the flexible dome comes into electrical contact with the second electrical conductor when the flexible dome is pressed with a first actuation force, and wherein the dome portion of the flexible dome comes into electrical contact with the third electrical conductor when the flexible dome is pressed with a second actuation force; a pushbutton disposed in the opening of the housing cover, wherein the pushbutton is movable in the opening of the housing cover for exerting force on the flexible dome via the spring and is urged away from the flexible dome; and at least one spring extending from the base for providing an electrical connection to at least one of the first, second and third electrical conductors of the base. The base may be larger than the housing cover disposed thereon, and electrical connections to the first, second and third electrical conductors of the base may be made by electrical conductors on the base, by electrical conductors extending from the base, or by electrical conductors on and extending from the base. The at least one spring may include two concentric springs extending in a direction generally parallel to a plane defined by the base. The electrical switch may further comprise: a second spring in the cavity between the base and the housing cover, the second spring having a first end bearing against the flexible dome and having a second end. The second spring may have a spring rate selected so that the pushbutton must be moved over a distance that is substantially greater than the actuation distance of the flexible dome in order to produce the second actuation force on the flexible dome, and/or may have a length that is substantially longer than the actuation distance of the flexible dome. The electrical switch may further comprise first and second housing parts defining a generally cylindrical module, wherein the base is disposed between the first and second housing parts with two concentric springs extending axially from the generally cylindrical module and with the pushbutton actuatable through an opening in the first housing part. The electrical switch may be in combination with a controller and a load, wherein the controller is responsive to the relatively shorter leg of the flexible dome making connection between the first and second peripheral electrical conductors of the base, to the dome portion of the flexible dome making connection between the central conductor and the first peripheral electrical conductor of the base, to the dome portion of the flexible dome breaking connection between the central conductor and the first peripheral electrical conductor of the base, to the relatively shorter leg of the flexible dome breaking connection between the first and second peripheral electrical conductors of the base, or to any combination of the foregoing, for controlling the load. Controlling the load may include energizing the load momentarily, energizing the load continuously, de-energizing the load, causing the load to alternate repetitively between energized and de-energized conditions, causing the load to change from a more energized condition to a less energized condition, causing the load to change from a less energized condition to a more energized condition, or any combination of the foregoing. The load may be an electrical light source, and the controller may control the light source to momentary ON, continuous ON, OFF, flashing, and dimming operating conditions, and optionally to an un-dimming operating condition.

An electrical flashlight may comprise: a housing having a head end and a tail end and having a cavity for receiving a battery; an electrical light source disposed proximate the head end of the housing; and a pushbutton switch disposed on the housing for providing at least two switch contacts, wherein the pushbutton switch includes an electrically conductive flexible dome having a plurality of relatively longer legs extending from a dome portion thereof, a relatively shorter leg extending from the dome portion thereof, wherein the relatively shorter leg of the flexible dome closes a first normally open switch contact of the at least two switch contacts when the flexible dome is pressed with a first actuation force, and wherein the dome portion of the flexible dome closes a second normally open switch contact of the at least two switch contacts when the first flexible dome is pressed with a second actuation force; a controller disposed in the housing and electrically connected to the electrical light source and to the battery when a battery is provided in the cavity of the housing for selectively coupling electrical power from the battery to the electrical light source, wherein the controller is electrically connected to the pushbutton switch and is responsive to closure, or opening, or both, of the at least two switch contacts thereof for controlling electrical power to the electrical light source at least for selectively energizing and de-energizing the electrical light source when the battery is present in the cavity of the housing. The electrical light source of the flashlight may be selectively energized and de-energized responsive to the pushbutton switch without electrical power to energize the light source flowing through the pushbutton switch. The pushbutton switch may include a base having at least first and second peripheral electrical conductors and a central electrical conductor thereon; wherein the electrically conductive flexible dome is disposed on the base, and wherein the plurality of relatively longer legs extending from a dome portion of the first electrically conductive flexible dome are in electrical contact with the first peripheral electrical conductor of the base, wherein the relatively shorter leg extending from the dome portion of the first electrically conductive flexible dome overlies the second peripheral electrical conductor of the base, and wherein the dome portion of the flexible dome overlies the central electrical conductor of the base. The pushbutton switch may include: a base having first, second and third electrical conductors thereon, and at least one spring extending from the base for providing an electrical connection to at least one of the first, second and third electrical conductors of the base. The at least one spring may include two concentric springs extending in a direction generally parallel to a plane defined by the base. The pushbutton switch may be disposed proximate the head end of the housing. The pushbutton switch may be disposed proximate the tail end of the housing. The pushbutton switch may further comprise: an actuator movable for exerting force on the flexible dome thereof via a spring, and for exerting force on the flexible dome thereof via the spring, wherein the actuator moves a distance for closing the normally open contacts of the flexible dome thereof that is substantially longer than an actuating distance of the flexible dome thereof. The controller may control electrical power to the electrical light source for energizing the electrical light source momentarily, for energizing the electrical light source continuously, for de-energizing the electrical light source, for causing the electrical light source to alternate repetitively between energized and de-energized conditions, for causing the electrical light source to change from a more energized condition to a less energized condition, for causing the electrical light source to change from a less energized condition to a more energized condition, or for any combination of the foregoing. The controller may control the electrical light source to momentary ON, to continuous ON, to OFF, to flashing, and to dimming operating conditions, and optionally to an un-dimming operating condition.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

While the present invention has been described in terms of the foregoing example embodiments, variations within the scope and spirit of the present invention as defined by the claims following will be apparent to those skilled in the art. For example, although an example two-pole switch arrangement 100 is described, additional switch elements similar to switch element 102 could be included between switch element 102 and plunger 170/spring 180, thereby to provide additional switch poles. In such arrangement, the force necessary to actuate the respective switch elements would typically be selected to increase monotonically in relation to the closeness of the switch element to housing base 130, 130'. I.e. the switch element closest to plunger 170 would typically have the lowest actuation force and the switch element closest to base 130, 130' would typically have the highest actuation force.

While two or more different example arrangements are shown for connecting a switch 100 in circuit with a controller 360, 360', e.g., as switches SW1, SW2 connected to different inputs of controller 360, 360' in circuits 300, 300', two or more switches 100 could be utilized in either illustrated arrangement, or two or more switches 100 could be utilized in like arrangements connected to the same or different inputs of the same controller 360, 360', or both switches 100 could be connected in parallel and to the same input of the controller 360, 360' or in any other arrangement as may be convenient or desirable in any given instance. Circuits 300, 300' and controllers 360, 360' could be provided by circuits of discrete electrical components, of commercially available integrated circuits, of custom integrated circuits, or of any combination thereof.

Further, either of resistors R1 or R3 of circuit 300 could have a very low ohmic value or could be replaced by a short circuit, without affecting operability of the circuits as described. Either of resistors R2*a* or R3*a* could have a very low ohmic value or could be replaced by a short circuit, and/or resistor R1*b* could have a low ohmic value or be replaced by a short circuit, without affecting operability of circuit 300' as described. In one example embodiment of circuit 300, resistor R3 is a short circuit, and in one example embodiment of circuit 300', resistors R1*b* and R3*a* are short circuits.

Notwithstanding that switch 100 is described herein in the context of a flashlight or other portable light, switch 100 may be utilized in and/or with any electrical and/or electronic apparatus, appliance and/or equipment, whether portable or stationary. The specific shape and form of housing 110, 120, 130, 130' containing switch element 102 may be varied to suit any particular intended use of a switch arrangement 100 as described.

While switch 100 is described as having a base 130 that optionally provides a circuit board for electrical components, electrical connections to switch 100 could be provided, e.g., extending from housing 120 and/or base 130, e.g., by conductive pins, leads and/or wires soldered to conductors on an electrical circuit board. In such case, base 130 could be substantially the size and shape of housing cover 120 at the location where housing cover 120 abuts base 130. Examples thereof may be found in U.S. patent application Ser. No. 11/734,598 filed Apr. 12, 2007, entitled "ELECTRICAL SWITCH HAVING STACKED SWITCHING ELEMENTS, AS FOR CONTROLLING A FLASHLIGHT" which is assigned to the assignee of the present Application and which is hereby incorporated herein by reference in its entirety.

Each of the U.S. Provisional Applications, U.S. Patent Applications, and/or U.S. Patents identified herein are hereby incorporated herein by reference in their entirety.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. An electrical flashlight comprising:

a housing having a head end and a tail end and having a cavity for receiving a battery;

an electrical light source disposed proximate the head end of said housing; and a switch disposed on said housing, comprising:

a switch housing;

an actuator displaceable within the switch housing;

a biasing element;

two normally open switch contacts;

a third contact;

an electrically conductive flexible dome, comprising:

a central body;

a plurality of first extensions connected with the central body; and a second extension connected from the central body;

wherein the biasing element is disposed between the actuator and the flexible dome;

wherein at least one of the first extensions engage the third contact prior to application of a first actuation force and the second extension contacts one of the two switch contacts when the first actuation force is applied to the dome, and wherein the central body closes a second of the normally open switch contacts when a second actuation force is applied to the dome;

wherein the light source is responsive to closure, or opening, or both, of the two switch contacts of the switch for energizing and de-energizing the electrical light source when the battery is present in the cavity of the housing;

wherein the biasing element extends the distance that the actuator is displaced to apply the second actuation force to the dome to close the second of the normally open switch contacts.

2. The electrical flashlight of claim 1 further comprising:

a controller disposed in the housing and electrically connected to the electrical light source and to the battery when a battery is provided in the cavity of the housing, wherein the controller is responsive to the two switch contacts of the switch for selectively coupling electrical power from the battery to the electrical light source.

3. The electrical flashlight of claim 2 wherein the controller is responsive to operation of the switch to control the electrical light source to a sequence of operating modes including at least momentary ON, continuous ON, flashing and OFF operating modes.

4. The electrical flashlight of claim 2 wherein the controller is responsive to operation of the switch to control electrical power to the electrical light source for energizing the electrical light source momentarily, for energizing the electrical light source continuously, for de-energizing the electrical light source, for causing the electrical light source to alternate repetitively between energized and de-energized conditions, for causing the electrical light source to change from a more energized condition to a less energized condition, for causing the electrical light source to change from a less energized condition to a more energized condition, or for any combination of the foregoing.

5. The electrical flashlight of claim 2 wherein the controller is responsive to operation of said switch to control the electrical light source to momentary ON, to continuous ON, to OFF, to flashing, and to dimming operating modes, and optionally to an un-dimming operating mode.

6. The electrical flashlight of claim 2 wherein in response to a momentary closure of the switch, the controller provides a first operating mode until a subsequent closure of the switch occurs.

7. The electrical flashlight of claim 2 wherein the controller responds to operations of the switch to control the light source, wherein the operations of the switch include: the number of actuations of the switch, the time between actuations of the switch, or the time of continuous actuation of the switch, or combination of the operations.

8. The electrical flashlight of claim 1 wherein the switch includes a base having first, second and third electrical conductors thereon, and further includes:

at least one spring extending from the base to provide an electrical connection to at least one of the first, second and third electrical conductors of the base; or two concentric springs extending in a direction generally parallel to a plane defined by the base.

9. The electrical flashlight of claim 1 wherein the switch comprises:

a pushbutton switch disposed proximate the head end of said housing; or a pushbutton switch disposed proximate the tail end of said housing; or a first pushbutton switch disposed proximate the head end of the housing and a second pushbutton switch disposed proximate the tail end of the housing.

10. The electrical flashlight of claim 1 wherein the switch further comprises:

an actuator movable for exerting force on the flexible dome thereof via the biasing element, wherein the actuator moves a distance for closing the normally open contacts of the flexible dome that is substantially longer than an actuating distance of the flexible dome.

11. The electrical flashlight of claim 1 wherein application of the first actuation force deforms at least one of the plurality of first extensions so that the second extension contacts one of the two switch contacts.

12. An electrical flashlight comprising:

a housing having a head end and a tail end and having a cavity for receiving a battery;

an electrical light source disposed proximate the head end of said housing; and a switch disposed on said housing, comprising:

a switch housing;

an actuator displaceable within the switch housing;

a biasing element;

two normally open switch contacts;

an electrically conductive flexible dome, comprising:

a central body;

a plurality of first extensions connected with the central body; and a second extension connected from the central body;

wherein the biasing element is disposed between the actuator and the flexible dome;

wherein application of a first actuation force to the dome deforms at least one of the first extension so that the second extension contacts one of the two switch contacts, and wherein the central body closes a second of the normally open switch contact when a second actuation force is applied to the dome;

wherein the light source is responsive to closure, or opening, or both, of the two switch contacts of the switch for energizing and de-energizing the electrical light source when the battery is present in the cavity of the housing;

wherein the biasing element extends the distance that the actuator is displaced to apply the second actuation force to the dome to close the second of the normally open switch contacts.

* * * * *